United States Patent [19]

Mosciatti et al.

[11] 4,232,353

[45] Nov. 4, 1980

[54] DOOR LOCK SECURITY SYSTEM

[76] Inventors: Roger Mosciatti, 6 Wycomb Pl., Coram, N.Y. 11727; Thomas P. Foley, 12 Janes La., Lloyd Harbor, N.Y. 11743; Frederick G. Moritz, 20 Aberdeen Rd., Hauppauge, N.Y. 11787

[21] Appl. No.: 917,082

[22] Filed: Jun. 19, 1978

[51] Int. Cl.[3] ..... E05B 49/00

[52] U.S. Cl. ..... 361/172; 70/277

[58] Field of Search ..... 361/172, 203; 70/277, 70/283

[56] References Cited

U.S. PATENT DOCUMENTS

| | | | |
|---|---|---|---|
| Re. 29,846 | 11/1978 | Genest et al. | 361/172 X |
| 2,882,455 | 4/1959 | Ferguson | 361/171 |
| 3,800,284 | 3/1974 | Zucker et al. | 340/149 R |
| 3,979,647 | 9/1976 | Perron et al. | 361/172 |
| 4,148,092 | 4/1979 | Martin | 361/172 |

*Primary Examiner*—Harry E. Moose, Jr.
*Attorney, Agent, or Firm*—Darby & Darby

[57] ABSTRACT

A door lock security system is disclosed in which each lock in a multiple lock system is modified by the addition of door lock security apparatus which, in electrical form, stores at least an individual key combination (and possibly several different levels of master key combinations) for the lock. Also, the conventional lock cylinder is replaced with a cylinder assembly which senses the magnetic reluctance state (high or low) of predetermined locations on a key substantially resembling a conventional cylinder lock key in size, weight and general shape and capable of mechanically operating the lock. The magnetic reluctance states of the predetermined locations digitally encode the key combination and the thus encoded combination is compared to the electrically stored one, disabling the mechanical operation of the lock unless the two combinations are identical. The electrical combination storage means within the door lock security apparatus may be placed in an adaptive state in which the combination of the next key inserted into the lock is stored as the lock combination and, thereafter, only a key with that combination will operate the lock. There is also provided an emergency key which overrides all other keys and, at any time, can operate any lock in a multiple lock system. This emergency key generates a time varying electrical signal which enables operation of any door lock despite its stored combination.

49 Claims, 22 Drawing Figures

FIG. 10
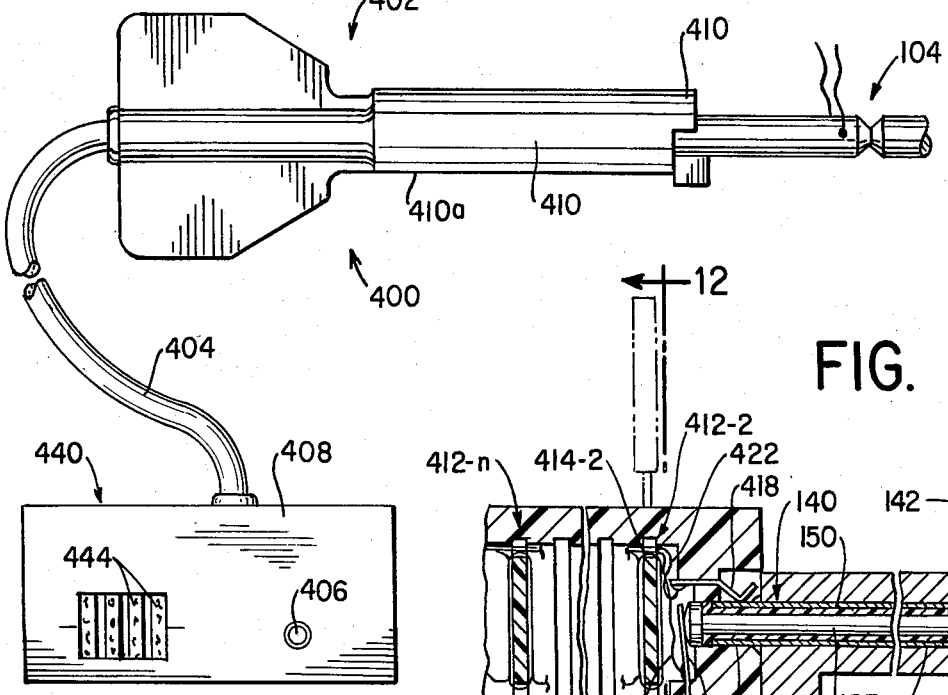
FIG. 11
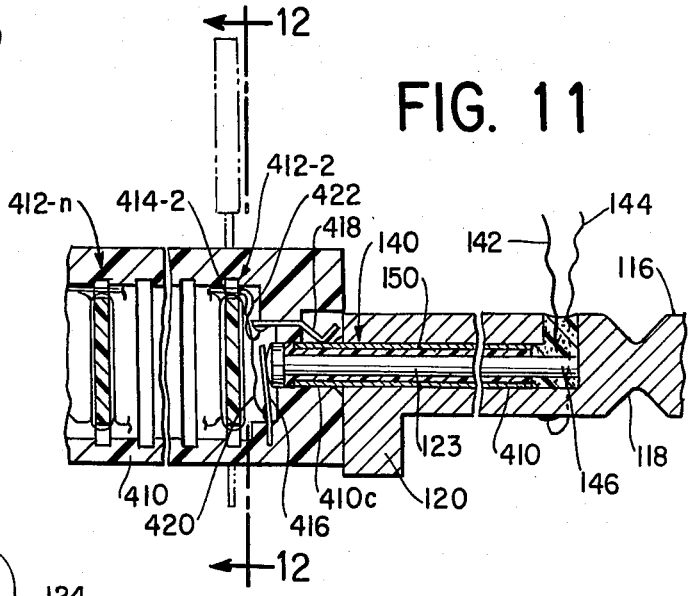
FIG. 12
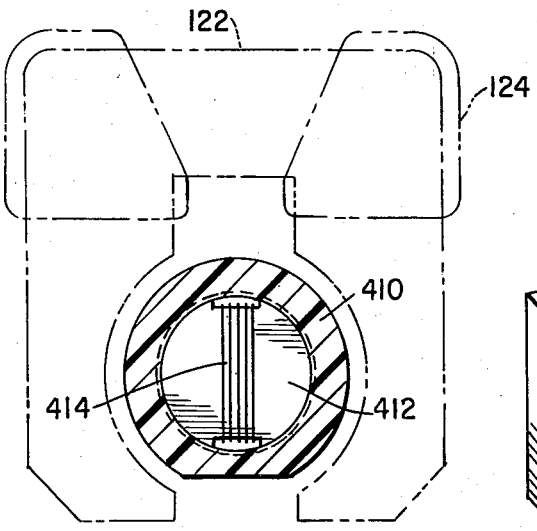
FIG. 13
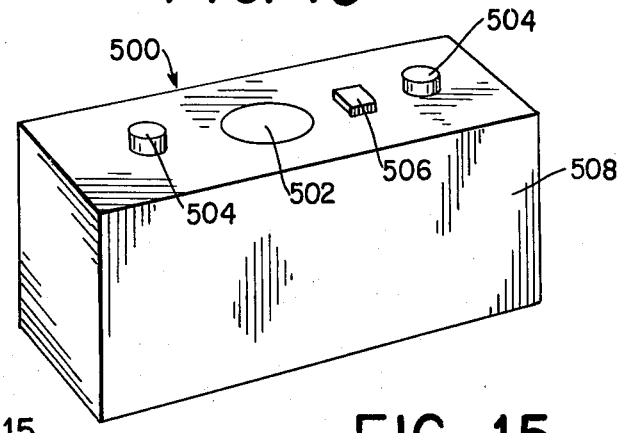
FIG. 15
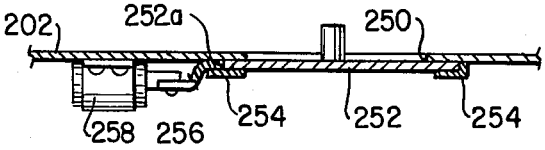
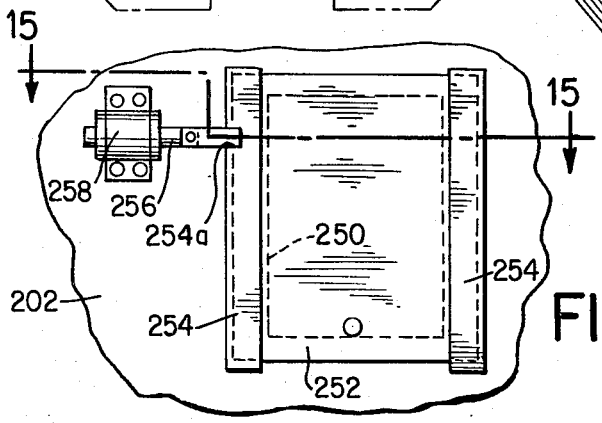
FIG. 14

278
F
263
BANDPASS FILTER
693
694
695
696
697
RESET CIRCUIT 644
681
682
685
690
683
688
680
687
689
692
287
REG. 684
REG. 686
INDIVIDUAL COMBINATION CIRCUIT 640A
648A
284-1
G
672-1
284-2
H
672-2
288
284-(n-1)
J
672-(n-1)
650A
670
284-n
646A
H/J
674-1
681
660
646B
674-2
MASTER COMBINATION CIRCUIT
652
290
640B
650B
658
674(n-1)
BRANCHING CIRCUIT 642
265
654
267
INDIVIDUAL/MASTER DECODER 266
271
656

DOOR LOCK SECURITY SYSTEM

This invention relates generally to a security lock system for doors and, in particular, concerns such a system which is adaptable to be operated by any one of a plurality of different keys.

In many applications, security of a door lock system including a plurality of different door locks dictates that the keys which operate the locks be changed periodically. For example, guest keys to hotel rooms are frequently lost, stolen or copied. Hotels also have a constant turnover of service personnel who have access to master keys and such personnel may lose master keys or may have the opportunity to copy them. Also, conventional pin tumbler locks have master keys which bear a structural relationship to the guest keys. A sophisticated thief could make a master key from just a few guest keys or could determine the master key configuration by renting a room and disassembling the cylinder in a conventional lock. Owing to all of these threats to hotel room security, guests are faced with a substantial risk of theft.

In an effort to maintain room security, hotels occasionally re-key the locks (i.e., change the key combination of the locks) in all their rooms. However, this proves to be an expensive undertaking, because a locksmith must be hired to change the locks, normal operation is disrupted during the change, some room occupancy is lost during the change, and once the change is completed the entire supply of guest keys must be discarded and replaced with a new one. What's more, the lock change provides only a temporary restoration of room security, since the loss, theft and copying of the new keys begins almost immediately.

Mechanical locks have been available which are adaptable to operate with a selected key which is one of a plurality of keys. Typically, such a lock is adjusted to an adaptive mode by authorized personnel and will operate with the first key that is used to open the lock. Thereafter, the lock will operate only with that key until it is once again adjusted to the adaptive mode. Locks of this type which can be adapted to different guest keys and master keys have been suggested for use in hotels as a solution to the lock re-keying problem. However, such locks are substantially more complex than conventional mechanical locks and, therefore, less reliable. Moreover, servicing such locks often requires highly skilled personnel, specialized equipment and unusual or expensive parts.

Electronic lock systems have also been available. These usually incorporate a computer which issues the individual guest keys, keeps account of them and monitors the locks on each room in the hotel. When such a system is used, the conventional door locks must normally be replaced by sophisticated units which include electronic and mechanical parts, and a communications link must be provided between the computer and the individual door locks. The computer must be maintained by a highly skilled technician or operator and computer outages often result in disruption in the normal operation of door locks. Furthermore, such a system requires standby power to permit normal operation in the event of a power failure.

Broadly, it is an object of the present invention to provide a door lock security system which overcomes one or more of the disadvantages inherent in present systems of this type. It is specifically within the contemplation of the present invention that a door lock be rekeyed quickly and easily, both as to an individual (guest) key and a master key by relatively unskilled authorized personnel.

It is another object of the invention to provide a door lock security system in which the combination of each lock can be changed to accept different individual (guest) and master keys without disassembling or physically restructuring the system. It is specifically contemplated that the adjustment to a new combination be made by simply operating the lock with a new key after it has been appropriately pre-set.

It is another object of the invention to provide a door lock security system including a plurality of door locks in which no central processor or operator are required to maintain the system.

It is a further object of the invention to provide a door lock security system including a plurality of door locks in which no special communications links are required either between individual door locks or between the door locks and a central control point.

It is yet another object of the invention to provide a door lock security system in which individual locks need not be connected to an external source of power so that the system operates normally during a power failure.

It is yet another object of the invention to provide a door lock security system in which the supply of keys need not be replaced when the combination of one or more locks is changed.

It is yet another object of the invention to provide a door lock security system including ordinary and master keys in which there is no correlation between the ordinary and master keys, so that the structure of a master key cannot be determined from one or more ordinary keys.

It is a further object of the invention to provide a door lock security system in which all ordinary and master keys look and feel alike and the mechanical structure of each lock bears no relationship to its combination so that the combination and that of the lock cannot be detected by sight or touch or without the use of some auxiliary equipment.

It is another object of the invention to provide a door lock which is immune to physical picking.

It is yet another object of the invention to provide a door lock security system which includes an emergency key capable of opening any lock at any time, which emergency key offers a maximum of security, but may have the combination thereof changed quickly and easily.

It is particularly an object of the invention to provide apparatus which can be used to convert existing mechanical locks to achieve one or more of the preceding objects with minimum modifications to the existing locks, door and/or building structure.

It is also an object of the present invention to provide a system and apparatus as described which are convenient, reliable and economical in use, yet relatively simple and inexpensive in construction.

In accordance with an illustrative embodiment demonstrating objects and features of the present invention, an existing mechanical door lock is modified by the addition of door lock security apparatus which, in electrical form, stores at least an individual key combination (and possibly several different levels of master key combinations) for the lock. Also, the conventional lock cylinder is replaced with a cylinder assembly which senses the magnetic reluctance state (high or low) of predetermined locations on a key substantially resembling a conventional cylinder lock key in size, weight and general shape and capable of mechanically operating the lock. The magnetic reluctance states of the predetermined locations digitally encode the key combination and the thus encoded combination is compared to the electrically stored one, disabling the mechanical operation of the lock unless the two combinations are identical. The electrical combination storage means within the door lock security apparatus may be placed in an adaptive state in which the combination of the next key inserted into the lock is stored as the lock combination and, thereafter, only a key with that combination will operate the lock. There is also provided an emergency key which overrides all other keys and, at any time, can operate any lock in a multiple lock system. This emergency key generates a time varying electrical signal which enables operation of any door lock despite its stored combination.

By utilizing the door lock security apparatus with each lock in a system including a plurality of locks, it is possible to re-key the locks on a continuous basis, thereby optimizing security. For example, in a hotel a supply of keys with different combinations could be kept in a container and, when a guest checks in, one key would be selected at random and a removable tag with his assigned room number placed thereon. Prior to check-in, the lock security apparatus in the assigned room would have been placed in the adaptive mode, for example, by the maid when cleaning up after the prior guest left. The first time the guest uses his key the lock security apparatus adapts thereto and will operate with no other guest key until once again reset to the adaptive mode. Security is optimized because the guest key combination is changed continuously and is, in fact, random and unknown even to hotel personnel at any point in time.

The foregoing brief description, as well as further objects, features and advantages of the present invention, will be more completely understood from the following detailed description of presently preferred, but nonetheless illustrative, embodiments in accordance with the present invention, with reference being had to the accompanying drawings, wherein:

FIG. 10 is a plan view of an emergency key assembly showing the emergency key portion thereof engaging a mating member within the lock;

FIG. 11 is a fragmentary sectional view, on an enlarged scale, taken in the vicinity of the point of engagement between the emergency key and its mating member in FIG. 10;

FIG. 12 is a sectional view taken along line 12—12 in FIG. 11;

FIG. 13 illustrates the general construction of a device useful for placing the door lock security apparatus in its adaptive mode with respect to an individual key;

FIG. 14 is an elevational view, on an enlarged scale, of a portion of the housing for the door lock security apparatus as seen from within the housing;

FIG. 15 is a sectional view taken substantially along contour 15—15 in FIG. 14;

Figure 1:
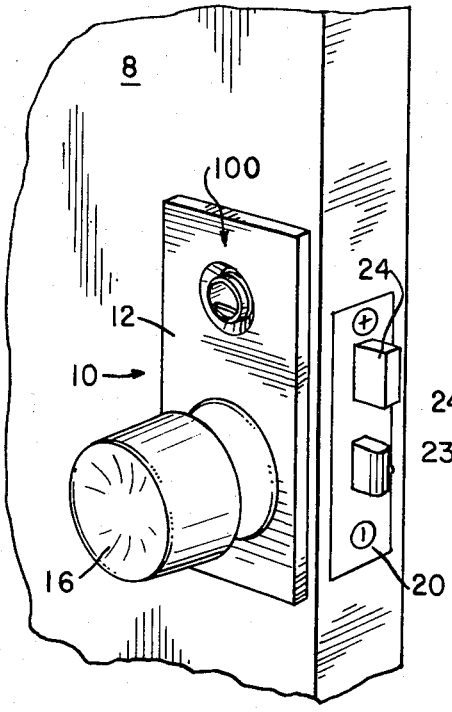
FIG. 1 is an external perspective view a door having a lock thereon modified in accordance with the present invention.

In a preferred form of the invention, apparatus is provided to modify a conventional mechanical lock in a door lock security system. For illustrative purposes, the invention will be described as applied to a Schlage GSIPD security lockset, which is widely used in hotel rooms. Such a lockset indludes (see FIGS. 1 and 2): an outside doorknob 16, an inside doorknob 18 which has a locking button, a thumbturn 22, a bolt mechanism 20 which includes a latchbolt 23 and a dead bolt 24, and a mechanical linkage (not shown) which connects the conventional lock cylinder, the doorknobs and the thumbturn to the latchbolt and dead bolt. The lock has the following operating characteristics:

(a) rotating either doorknob retracts the latchbolt;
(b) the outside doorknob may be disengaged by turning the button on the inside doorknob;
(c) rotating of the thumbturn from inside, or the key from outside, extends the deadbolt;
(d) rotating the doorknob or thumbturn from inside, or the key from outside causes both the latchbolt and deadbolt to be retracted.

In the preferred embodiments of the invention, a conventional lockset 10 is modified by the addition of door lock security apparatus without changing the basic operation of the lockset. The door lock security apparatus broadly comprises: a cylinder assembly 100; a control assembly 200; a plurality of ordinary and master keys 300; an emergency key assembly 400; and a reset pack 500. The lockset, modified by the addition of the door lock security apparatus provides the following general operative features, all of which are discussed in more detail hereinafter:

(a) A system incorporating a plurality of modified locksets includes a plurality of different individual keys each capable of operating one modified lockset, a plurality of different master keys each capable of operating a group of modified locksets and at least one emergency key assembly 400 capable of operating any modified lockset;

(b) Control assembly 200 includes electronics which stores preprogrammed individual key, master key and emergency combinations, recognizes the combination of any key inserted into cylinder assembly 100 and permits the key to be turned in order to operate the lock (in the usual manner) only when the key contains a stored combination;

(c) By using reset pack 500, the electronics of control assembly 200 may be placed in an adaptive mode with respect to the individual key combination, in which mode the combination of the individual key which is used first is stored as the correct combination and, thereafter only that individual key will be able to open the lock;

(d) When the emergency key is inserted into cylinder assembly 100, the electronics in control assembly 200 can be placed in an adaptive mode with respect to the master key combination, in which mode the combination of the next inserted master key is stored as the correct combination and, thereafter, only that master key will be able to operate the lock;

(e) When the emergency key is inserted into cylinder assembly 100, access may be gained to the interior of control assembly 200 for repairs or adjustments, such as changing the emergency key combination to be recognized.

(f) In order to lock lockset 10 from inside, a pushbutton 204 must be depressed and this conditions the electronics in control assembly 200 so that only the correct individual key or the emergency key can operate the lock (i.e. the master key is excluded);

(g) Depressing pushbutton 204 also causes electric power to be supplied to the room heater, air conditioner or other unit consuming high energy and subsequent use of the correct individual key turns off the power so that energy is not wasted when the occupant leaves the room; and (h) An indicator 209 is provided which is illuminated when an individual or master key is present in cylinder assembly 100, which flashes at a fast rate when a battery provided inside control assembly 200 begins to fail, and which flashes at a slow rate when reset pack 500 is utilized to place control assembly 200 in the adaptive mode with respect to the individual key combination.

Figure 2:
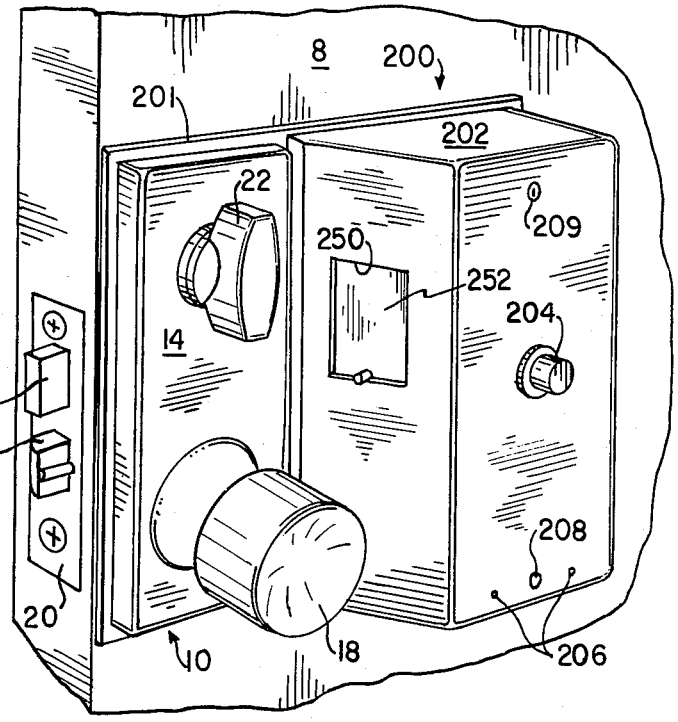
FIG. 2 is a perspective view of the door in FIG. 1 as seen from the interior side thereof.

Referring to FIGS. 1 and 2, there is shown a door 8 with a conventional mechanical lockset 10 mounted thereon. The lock set 10 includes outside and inside faceplates 12, 14 in addition to the other components already discussed. The conventional pin tumbler cylinder of the lockset is removed from its mounting hole 8*a* in door 8 and is replaced by the cylinder assembly 100, which is coupled to bolt mechanism 20 by the same mechanical linkage that originally coupled the pin tumbler cylinder thereto.

A control assembly 200 is mounted on a plate 201 mounted against the inside surface of door 8, alongside inner faceplate 14. Control assembly 200 includes all of the electronics required to control the operation of the security system, as well as batteries, all of which are housed under a protective cover 202.

Figure 3:
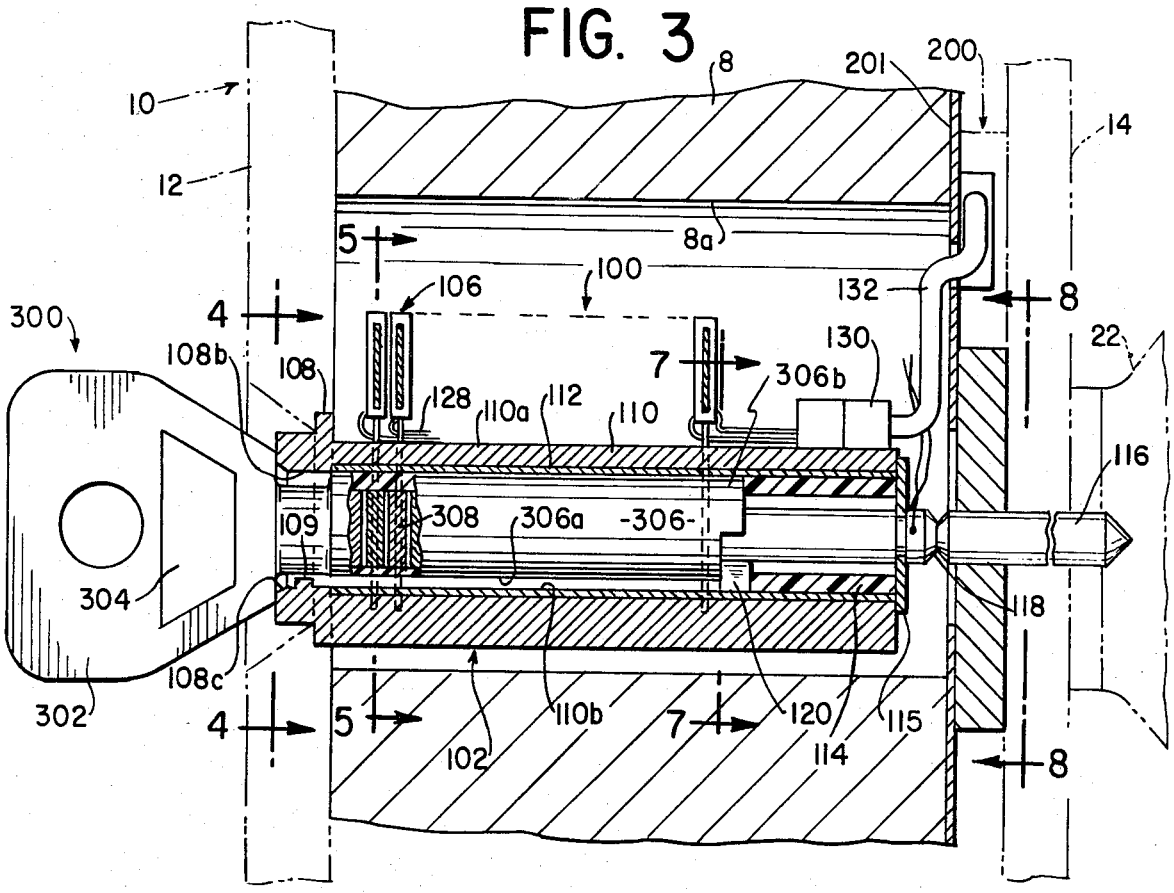
FIG. 3 is a fragmentary sectional view, on an enlarged scale of the upper portion of the lock as seen from the edge of the door, a key being inserted into the lock in operational position.
Figure 4:
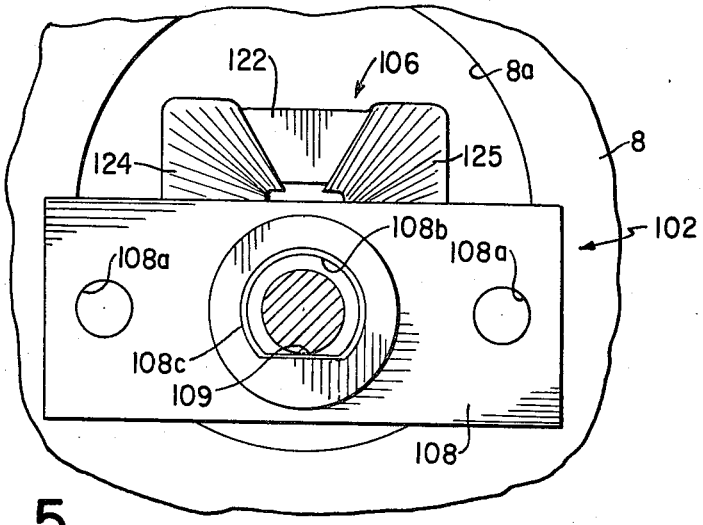
FIG. 4 is a sectional view taken along line 4—4 in FIG. 3.
Figure 5:
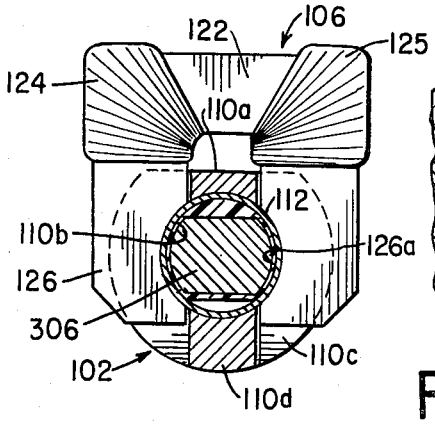
FIG. 5 is a sectional view taken along line 5—5 in FIG. 3.
Figure 6:
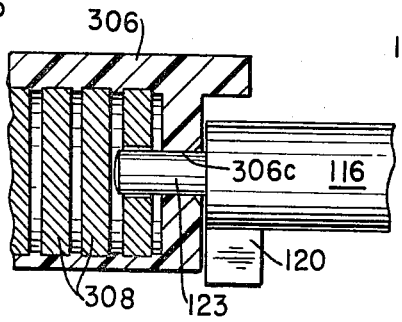
FIG. 6 is a fragmentary view, on an enlarged scale, in the vicinity of the innermost tip of the key, with the key being shown in section.

The door lock security apparatus also includes a plurality of inactive individual and master keys, of which key 300 of FIG. 3 is typical; at least one emergency key assembly 400 (see FIG. 10) including an active emergency key 402 coupled to emergency key electronics 400 by means of a cable 404; and a reset pack 500 including a light-emitting diode 502, registration pins 504 and an actuating switch 506, all of which are mounted on a housing 508 which encloses the reset pack electronics.

As is conventional with bolt mechanisms, the dead bolt 24 is advanced and retracted by means of a rotatable spindle. By design, control assembly 200 locks this spindle against rotation and maintains deadbolt 24 in its extended position when a correct regular key, master key or the emergency key is not inserted into cylinder assembly 100. However, the deadbolt 24 may be operated by pressing release button 204 and turning thumbturn 22 when inside the room. When the correct ordinary key or a correct master or the emergency key are inserted into cylinder assembly 100 as shown in FIG. 3, control assembly 200 releases the spindle which operates bolt mechanism 24 and the inserted key may be turned to retract or extend deadbolt 24 and unlock or lock the door 8.

The individual key combination for the door lock security apparatus is reset with the aid of reset pack 500. This is achieved by applying the reset pack to cover 202 so that registry pins 504 enter guide holes 206, whereby light-emitting diode 502 is aligned with a photosensor 208. When reset pack 500 is pressed against cover 202, light-emitting diode 502 emits a reset signal of predetermined frequency which is detected by photo sensor 208, so that the security apparatus is placed in an adaptive mode. Thereinafter, the first individual key which is inserted into cylinder assembly 100 sets the security system to operate with only that individual key.

Also, the security system may be placed in an adaptive mode to receive a new master key. This is achieved by inserting the correct emergency key into cylinder assembly 100 and pressing button 406 in housing 408 of emergency key electronics 440. Thereafter, the first master key to be inserted into cylinder assembly 100 adjusts the security apparatus to operate only with that master key.

When necessary, the emergency key combination may be changed by accessing control assembly 200 through a sliding door 252. This door is normally locked, but may be opened when the emergency key is inserted into cylinder assembly 100. Once the door 252 is opened, the emergency key combination is changed by adjusting thumbwheel switches, or the like.

Referring now to FIGS. 3–7, there are shown the details of cylinder assembly 100 and a key 300 which is typical of the individual and master keys of the illustrative embodiments. Cylinder assembly 100 broadly comprises: a main body 102, which receives the key 300; a shaft assembly 104 which mounts in body 102 and couples key 300 to the operating linkage for bolt mechanism 20; and a plurality of sensor elements 106-1 through **106-*n* (referred to collectively as sensor elements 106), which are mounted in axially spaced relationship along body 102 and are electrically connected to control assembly 200. The key 300 broadly comprises a head 302 on which there is mounted a removable room tag 304 and a shank portion 306 within which there are provided a plurality of axially spaced code elements 308-1 through 308-*n* (referred to collectively as code elements 308), each of which is positioned to cooperate with one of the sensor elements 106**. Cooperating sensor and code elements have reference characters with a corresponding suffix to emphasize this cooperation.

Cylinder body 102 may be made of any strong, non-magnetic, non-conducting material. Body 102 includes a bracket portion 108 which engages the outside of door 8 and a housing portion 110 which extends into hole 8*a* in the manner of a conventional pin tumbler cylinder. The bracket portion 108 has a pair of holes 108*a*, similar to a conventional pin tumber assembly, which permit the passage of registry pins, or the like. Bracket portion 108 is held in position by means of these registry pins and the pressure from outer faceplate 12 bearing against the outer surface of door 8. Bracket portion 108 is also provided with a bore 108*b* which accepts key 300 and has a tapered mouth 108*c* which guides the key into bore 108*b*. The lower part of bore 108*b* is partially blocked by a web 109, when serving as a key guide, as will be explained below. Housing portion 110 is generally cylindrical, but has a flat-topped coaxial bore 110*b* which is slightly larger in diameter than bore 108*b*. Housing portion 110 also includes a plurality of opposed pairs of channels 110*c*, which pairs are spaced axially along the length of housing portion 110. Each pair of channels is cut inwardly from opposite sides of housing member 110 so as to produce a wall 110*d* between them which has parallel edges and is thinner than the diameter of bore 110*b*. The channels 110*c* are dimensioned to accommodate the thickness of sensor elements 106, as will be explained more completely below. Tube 112 is designed to have a slight interference fit within and to be axially coextensive with bore 110*b*. In addition, it has an inside diameter which is equal to the diameter of bore 108*b*. Tube 112 may be made of any non-magnetic, non-conducting material.

Shaft assembly 104 includes: a tubular insert 114 which has an interference fit within tube 112 and is preferably made of nylon; a shaft 116, which is journalled in tubular insert 114 and couples key 300 to the mechanical linkage of lock 10; and a snap-ring 115 which is mounted on shaft 116 to prevent it from sliding axially inwardly. Shaft 116 is preferably made of steel and has a cross-sectional shape identical to that of the end shaft in a conventional pin tumbler cylinder (i.e., it is cylindrical with a flat upper and lower surface). A reduced section 118 is provided so that, in the event that excessive pressure is applied to key 300 in an attempt to break lock 10, section 118 breaks before any damage occurs to the lock. At its innermost end, shaft 116 includes a cam portion 120 which couples the shaft to key 300 while permitting 90 degrees of free turning movement, as will be explained more completely below.

Sensor elements 106 are all identical. Hence, only one of them will be described in detail. Each of sensor elements 106 includes a thin, generally U-shaped core element 122 which is made of a ferrous material, and primary and secondary windings 124, 125 which are wound on core 122. Each of the legs 126 of core element 122 has an arcuate cutout 126*a* on its inwardly directed edge, which cutout is designed to conform to the exterior cross-sectional contour of tube 112. The electrical leads 128 from sensor elements 106 are connected to a conventional connector 130 which is mounted on surface 110*a* and are coupled therefrom to control assembly 200 via a harness 132.

The components of cylinder assembly 100 are designed for quick and convenient assembly. As an initial step, shaft assembly 104 is mounted in tube 112 by pressing insert 114 into one end of the tube until snap-ring 115 comes into contact with the tube. Next, each of the sensor elements 106 is mounted to cylinder body 102 by inserting the legs 126 into corresponding channels 110*c* until the cutouts 126*a* align with bore 110*b*. Then, the open end of tube 112 is inserted into bore 110*b* and is pressed thereinto until snap-ring 115 contacts housing portion 110. With tube 112 in this position, sensor elements 106 cannot be removed from cylinder body 102. As a final step, the connector 130 with the harness 132 secured to it is affixed to surface 110*a* and the leads 128 are secured to connector 130.

Key 300 may be made of any non-magnetic material by conventional processes, but is preferably molded from plastic. It includes a head 302 to which a tag is removably secured and a shank portion 306. Shank portion 306 is generally cylindrical, but includes a flat bottom 306*a* and a boss 306*b* at one end in the shape of a quarter circle. On its interior, shank portion 306 includes a plurality of axially spaced compartments, each of which is adapted to receive a generally disc-shaped sensor actuating member 308, which may be an active element or an inactive element, depending on the material from which it is made (active elements are made from a magnetic material and inactive elements are made from a non-magnetic material). At the end of shank 306 opposite head 302, there is an axial bore 306*c* with a flared mouth which is dimensioned to receive protrusion 123 of shaft assembly 104. The primary distinction between an individual key and a master key is that a predefined one of the actuating elements. For example, element 308-*n* is always active in a master key and inactive in an ordinary key.

Figure 8:
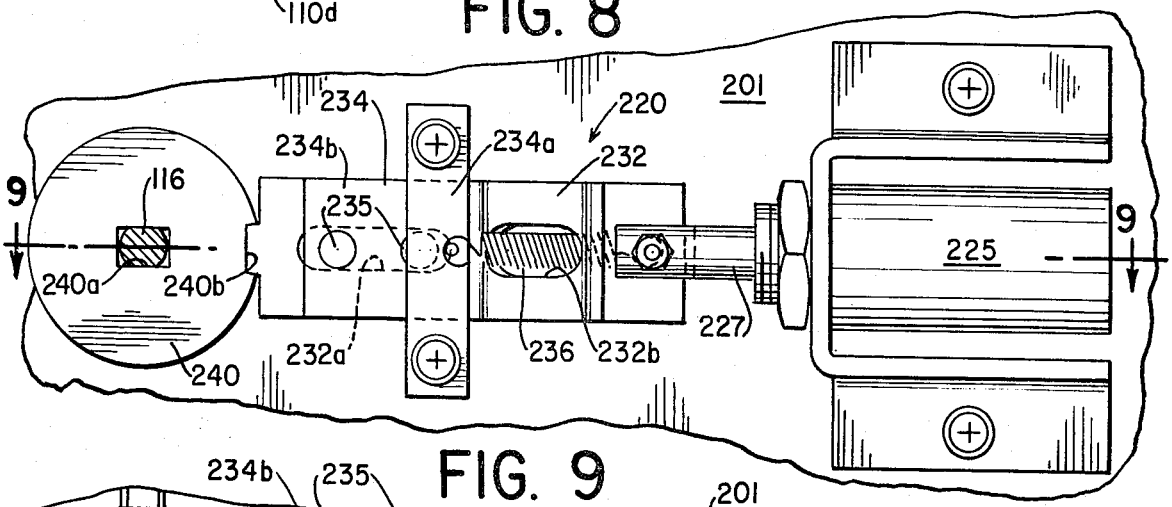
FIG. 8 is a fragmentary sectional view taken along line 8—8 in FIG. 3.
Figure 9:
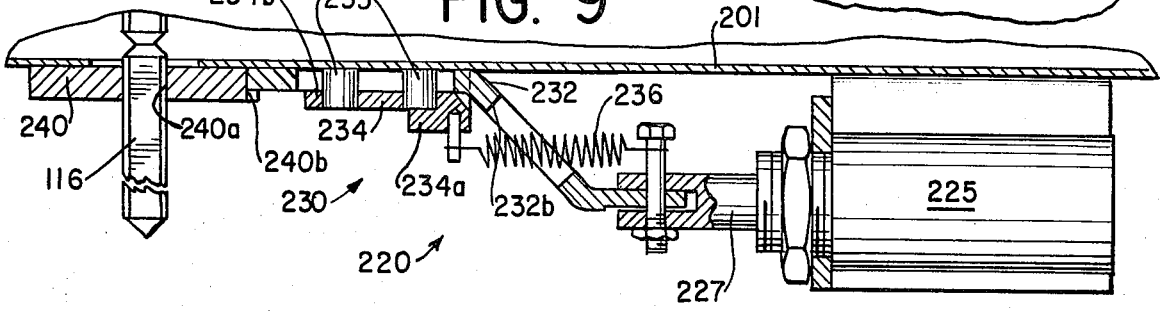
FIG. 9 is a sectional view taken along line 9—9 in FIG. 8.

Referring to FIGS. 8 and 9, there is shown a linkage mechanism 220 by means of which control assembly 200 is mechanically coupled to lockset 10. Linkage 220 includes: a solenoid 225 which is controlled by the electronics of control assembly 200 and is secured on plate 201 by conventional means; a slide assembly 230 slidably mounted on plate 201 for operation by solenoid 225; and a locking disc 240 which is mounted on shaft 116 and is captured by slide mechanism 230. Disc 240 is housed under faceplate 14 of lockset 10 and solenoid 225 and mechanism 230 are housed under cover 202, with a portion of slide mechanism 230 extending under faceplate 14.

Locking disc 240 is preferably made of steel. It has a central aperture 240*a* which is dimensioned for a snug fit on shaft 116 of cylinder assembly 100. It also has a peripheral slot 240*b* which is nearly rectangular, with opposed edges which flare slightly outwardly, preferably at an angle of less than 5 degrees. When dead bolt 24 is extended, as shown in FIGS. 1 and 2, disc 240 is positioned as shown in FIGS. 8 and 9.

Slide assembly 230 is preferably made of steel. It includes a slide 232; a slide retainer 234, which is mounted to plate 201 so as to slidably retain slide 232; and a tension spring 236 which is connected between slide 232 and retainer 234. Slide 232 is bent into a slight S-shape, so that it may slide against plate 201 while being connected to solenoid plunger 227, and includes a pair of elongated cutouts 232*a* and 232*b*. The retainer 234 includes a bracket portion 234*a*, which is secured to plate 201 by conventional means and a retaining portion 234*b* which holds slide 232 against plate 201. Retaining portion 234*b* also includes a pair of pins 235 which extend through cutout 232*a* in slide 232 and engage plate 201. With this construction, slide 232 slides freely between plate 201 and retaining portion 234*b* and is guided by pins 235. Spring 236 passes through cutout 232*b* in slide 232 and applied a force to the slide which urges it towards locking disc 240, so that slide 232 engages locking disc 240 when solenoid 225 is inactive.

Solenoid 225 is a conventional solenoid which is mounted to plate 201 by conventional means. It has a plunger 227 to which one end of slide 232 is connected by conventional means. When the solenoid is activated by electronics in control assembly 200, plunger 227 is retracted, so that slide 232 is drawn away from disc 240. When the solenoid is inactive, spring 236 urges slide 232 into contact with disc 240, as already explained.

The electronics comprising control assembly 200 will be discussed in detail hereinafter. However, a general understanding of the operation of the door lock security system of the invention can be obtained from the description thus far. In operation, each of sensor elements 106 of cylinder assembly 100 functions as a transformer in which the windings 124 is a primary and the windings 125 is a secondary, and element 122 serves as a common core for the two windings. The space between the legs 126 of core 122 in which shank portion 306 of key 300 is received is essentially a gap is a continuous core. When the key 300 is inserted into cylinder assembly 100, this gap is filled by the actuating element 308 corresponding to each sensor element 106. If the actuating element is an active one (i.e., made of magnetic material) there is a continuous, low reluctance magnetic path through core 122 and element 308, so that there is strong coupling between the primary and secondary windings 124, 125 of that core element. On the other hand, if the actuating element is an inactive one (i.e., made of non-magnetic material), there is essentially a gap in the core which produces a high reluctance magnetic path and little coupling between the primary and secondary windings.

Thus, if a signal of fixed frequency is applied to each of the primary windings and the signal on each of the secondary windings is sensed, those of sensor elements 106 which have an active respective actuating element will have the primary winding signal strongly coupled to the secondary whereas those sensor elements 106 having an inactive respective actuating element will have little or none of the primary signal coupled to the secondary. Hence, the arrangement of inactive and active elements on key 300 is reflected on the secondary windings of sensor elements 106 as a pattern of low level and high level signals, respectively, at the predefined frequency. Within control assembly 200, this pattern of signals is compared to a stored pattern which represents the combination of the lock. When the two patterns agree, solenoid 225 is actuated to retract plunger 227, so that disc 240 and shaft 116 are free to rotate, whereby dead bolt 24 may be extended or retracted by rotating shaft 116 by means of key 300. If the two patterns are not alike, solenoid 225 is inactive and slide 232 prevents the rotation of disc 240 and shaft 116.

Figure 7:
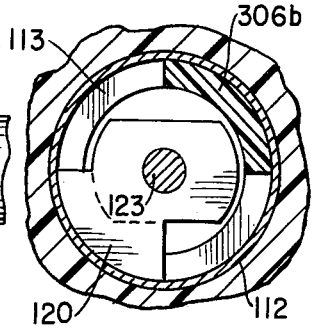
FIG. 7 is a sectional view taken along line 7—7 in FIG. 3.

With shaft 116 positioned as shown in FIGS. 7–9, slide 232 locks disc 240 and lock 10 is in a neutral condition (i.e., dead bolt 24 may be either extended or retracted, depending on its condition before the neutral condition was attained). Lock 10 is locked (i.e., dead bolt 24 is extended) when shaft 116 is rotated 90 degrees counterclockwise (in FIG. 8) so that detent 240*b* is directed upward. The lock is open (i.e., dead bolt 24 is retracted) when shaft 116 is rotated so that detent 240*b* is directed downward. When solenoid 225 is actuated to attract slide 232, such as when a key 300 with a correct combination is inserted into cylinder assembly 100, disc 240 is free to rotate and shaft 116 can be rotated freely, so that lock 10 may be opened and closed at will. However, when solenoid 225 is not actuated, such as when an incorrect key 300 is inserted into cylinder assembly 100, spring 236 urges slide 232 towards disc 240. If an attempt is made to rotate shaft 116 from either the open or closed position to the other position, detent 240*b* is captured by slide 232, thereby locking up shaft 116 in the neutral condition and causing lock 10 to remain in the same condition (either closed or open).

Referring now to FIGS. 10–12, there are disclosed the details of emergency key assembly 400. As can be seen in FIG. 10, key 402 of emergency key assembly 400 is identical to key 300 in physical appearance and is used in the same manner. The primary distinction between the two keys is that key 300 was inactive (i.e., it merely included actuating elements 308 which determine the electromagnetic coupling within sensor elements 106), whereas key 402 incorporates an internal element which is located at a selected element position and which is active (i.e., they generate an electromagnet signal which is detected by sensors 106). Emergency key assembly 400 also provides power to control assembly 200 so that the door lock security system can be operated in the event that the battery within control assembly 200 fails. This will be described in more detail below.

Within shank portion 410 of key 402, there is provided an active element 412 which is axially positioned along shank portion 410 so as to coincide with a predetermined one of the sensors 106. In FIG. 11, the active element is show in position (position 1 is used only in individual and master keys) for illustrative purposes, but it will be appreciated that it may be provided in any position along the key shank. A second active element is also provided at position n to permit changing of the master key combination, as will be explained further below. The active element 412 is a generally disc-shaped member made of magnetic material and includes a winding 414 which is coupled to emergency key electronics 440. Emergency key electronics 440 provide any one of a multiplicity of time varying pulse patterns, the particular pattern being selected by operating selector 444, which may be an arrangement of thumb wheel switches, or the like. At the end of shank portion 410, there is provided a bore 410*c* which, like bore 306*c* in key 300, receives protrusion 123 of shaft assembly 104. Contacts 416 and 418 are disposed within shank portion 410 so as to contact the tip and body of protrusion 123, respectively, when emergency key 402 is inserted into cylinder assembly 100. Contacts 416 and 418 are connected via leads 420 and 422 to the positive and ground sides, respectively, of a battery which is included in emergency key electronics 440.

At this point, it becomes necessary to define further features of shaft assembly 104, which were not previously relevent. Referring to FIG. 11, it will now be described how electric power is coupled from contacts 416 and 418 to control assembly 200. Protrusion 123 is merely the projecting portion of a coaxial conductor 140 which extends axially within shaft 116 and includes leads 142 and 144 which are connected via harness 132 to the positive and ground sides, respectively, of a battery included in control assembly 200. Conductor 140 includes a pin 146, an insulative sleeve 148 over pin 146, and a conductive sleeve 150 over sleeve 148. When emergency key 402 is inserted into cylinder assembly 100, protrusion 123 enters bore 410*c*. As a result, pin 146 engages contact 416 and sleeve 150 engages contact 418. This establishes an electrical connection between the corresponding terminals of the batteries in emergency key electronics 440 and control assembly 200. The connection between the positive terminals is via lead 420, contact 416, pin 148 and lead 142, whereas the connection between the ground terminals is via lead 422, contact 418, sleeve 150 and lead 144. This permits control assembly 200 to be operated with power from emergency key 402 in the event that the battery in control assembly 200 fails.

In practice, the electronics in control assembly 200 is preadjusted to recognize a predetermined pulse pattern on the secondary windings of predetermined ones of sensors 106. Thus, any door in an entire hotel, for example, could be opened by adjusting combination device 444 of emergency key electronics 440 to the correct combination and using key 402 in the same manner as key 300. In operation, adjusting combination selector 444 places the predetermined pulse pattern on the winding 414 when a pushbutton 405 is pressed, thereby inducing a magnetic field in the element 412. This field is coupled through the respective core 122 to its secondary winding 125. Within control assembly 200, the signal from each of the secondary windings 125 is sensed and, when the predetermined pulse pattern is detected on the predetermined secondary winding, solenoid 225 is activated. This permits dead bolt 24 to be extended and retracted, as previously explained.

The interior of cover 202 may be accessed through window 250 in order to change the combination of control assembly 200, to change the battery therein, or to make some other simple adjustments. Access through window 250 is normally prevented by a cover 252 which is normally locked, but may manually be raised after an emergency key with the correct combination is inserted into cylinder assembly 100. As can be seen in FIGS. 14 and 15, door 252 is slidably mounted to the interior of cover 202 by means of a pair of opposed channel elements 254. The plunger 256 of a solenoid 258 extends through an aperture 254*a* in one of the elements 254 and into a detent 252*a* in door 252, which detent is aligned with the aperture 254*a*. In operation, the plunger 256 is retained in the position shown in FIGS. 14 and 15 by spring means (not shown) when the solenoid 258 is inactive. When an emergency key with the correct combination is inserted into cylinder assembly 100, solenoid 258 is actuated so that plunger 256 is withdrawn from aperture 254*a* and window 252 can be freely slid upward. When door 252 is released, it drops downward of its own weight and is once again locked in place when emergency key 402 is withdrawn from cylinder assembly 100.

The electronic circuits which form part of the preferred embodiments of the invention and which are described in detail hereinafter, incorporate various conventional analog and digital circuit building blocks which are generally described below.

Three types of logic gates will be employed: inverters, AND gates, and OR gates. An inverter has a single input and a single output which is always the complement of the input (i.e., the output always assumes the opposite condition of the input). An AND gate has a plurality of inputs and has a single output which assumes a high or logical 1 condition only when all of the inputs are high. An OR gate has a plurality of inputs and a single output which assumes a logical 1 or high condition when any of the inputs is high.

Two types of storage elements are employed: D type flip-flops and storage registers. A D flip-flop has a D or data input, a C or clock input, a P or preset input, a R or reset input and two complementary outputs Q and Q. Upon the occurrence of a positive-going transition at the clock input, the Q output assumes the logical condition that the signal at the D input had immediately prior to the positive-going clock transition. The Q output assumes the opposite condition. When a low level is applied to the P and the R inputs, the flip-fop is respectively set (i.e., the Q output assumes the logical 1 condition and reset (i.e., the Q output assumes a logical 1 condition), independently of the C and D inputs. A storage register consists of a plurality of D flip-flops connected in parallel to store a multi-bit word. The register has a single clock input C, a plurality of data inputs and a plurality of outputs.

A counter has a C or clock input, a R or reset input, and a plurality of output bits defining the count of the counter With the R input low, the count of the counter is incremented on each positive going transition of the signal applied to the C input, so that the counter repetitively cycles from a zero count to its maximum count. When the R input is high, the counter is reset to the zero count. The size of the counter is defined in terms of the number of stages or output bits it has. Thus, an N bit counter is capable of counting from zero to $2^N$. A divide-by-P counter is a conventional counter which has a single output, incorporates logic to reset the counter after a count of P is reached, and produces a pulse at the output only when such a count is reached. In effect, the counter produces a pulse train having 1/P times the frequency of a pulse train applied as an input signal to it.

A digital comparator has two multi-bit binary input words A and B and a single output bit which assumes a logical 1 condition only when the two words are identical.

A one-shot circuit or monostable multivibrator has a single input and complementary outputs indicated as Q and Q. On the positive going transition of a pulse applied to the input, the one-shot produces a positive going pulse of predetermined duration at its Q output and a negative pulse of the same duration at its Q output. When this pulse terminates the one-shot is said to have "timed out". One-shots may be retriggered while they are producing an output pulse, in which case timing of the pulse begins from the occurrence of the later trigger.

An analog comparator is an analog circuit which receives analog reference input and information input signals and produces a logical 1 output when the information input signal exceeds the reference input signal and a logical zero output otherwise.

An analog gate has a control input and two output terminals. Depending on the amplitude of a voltage applied to the input, the output terminals are either shorted together or isolated.

Figure 16:
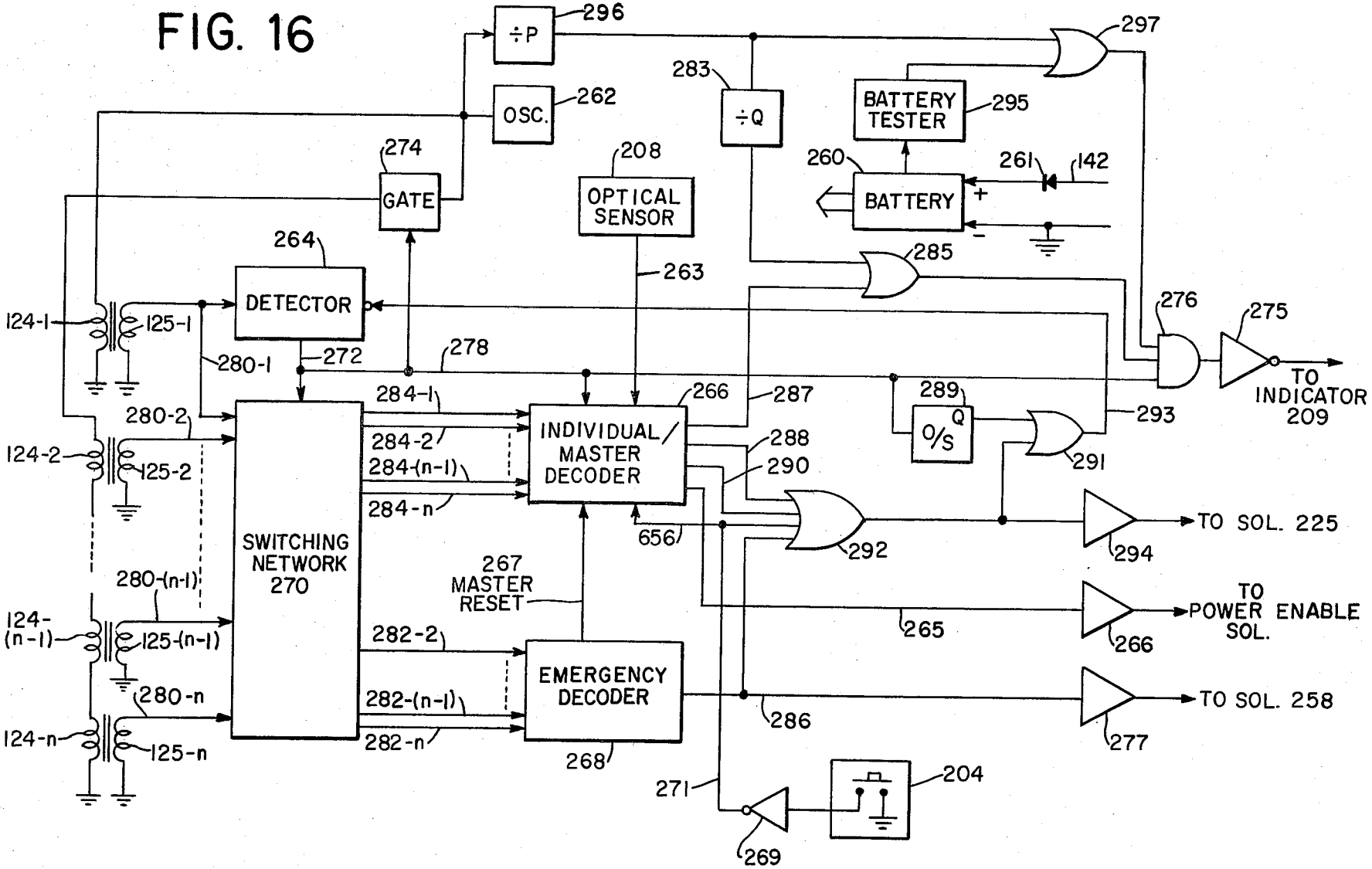
FIG. 16 is a functional block schematic diagram illustrating the electronics of the door lock security apparatus.

Referring now to FIG. 16, there is provided a functional block diagram of the electronics incorporated in control assembly 200. Although not part of control assembly 200, the primary and secondary windings 124 and 125 of sensor elements 106 are coupled to the control assembly 200 and are therefore included in the diagram. Control assembly 200 broadly comprises: a battery 260 which provides power for all of the electronic and electrical components of the door lock security apparatus; an oscillator 262 which produces a signal of predetermined frequency for application to primary windings 124 of sensor elements 106; a detector 264 which senses the signal on secondary winding 125-1 and produces a binary control signal which indicates when either an individual or master key is present within cylinder assembly 100; an individual/master decoder 266 which senses when a key with the correct individual or master combination is present within cylinder assembly 100 and produces signals to actuate solenoid 225; an emergency decoder 268 which senses when an emergency key with the correct emergency combination is present within cylinder assembly 100 and produces a signal to actuate solenoids 225 and 258; and a switching network 270 which receives the signals from each of secondary windings 125 and provides them to either individual/master decoder 266 or emergency decoder 268, depending on the state of the control signal produced by detector 264.

In the preferred embodiment, sensor element 106-1 is dedicated to indicating when an individual or master key is present in cylinder assembly 100 (i.e., all individual and master keys have an active element 308-1, whereas the emergency key has no element in that position). This indication is provided by detector 264 which produces a logical 1 signal on lead 272 when an individual or master key is present and a logical zero otherwise. This signal from detector 264 is provided to switching network 270 via lead 272 and to an analog gate 274, individual/master decoder 266, AND gate 276, and one-shot 289 via leads 272 and 278. Gate 274 is a conventional analog gate which is open when its control input is low and is conductive when its control input is high. Since the signal from detector 264 is low in the absence of an individual or master key, gate 274 will be open, thereby isolating windings 124-2 through **124-*n* from oscillator 262. At the same time, the low signal from detector 264 causes switching network 270 to couple secondary windings 125-2 through 125-*n* which are coupled to switching network 270 via leads 280-2 through 280-*n*, to leads 282-2 through 282-*n*, respectively, thereby coupling the secondary windings to emergency decoder 268. Thus, if an emergency key is present in cylinder assembly 100, it will be possible to detect its code in emergency decoder 268. If the correct emergency code is present, a logical 1 level is produced on lead 286 and solenoid 225 is activated through OR gate 292 and inverter 294 and solenoid 258 is activated through inverter 277**.

When an individual or master key is present in cylinder assembly 100, windings 124-1 and 125-1 are electromagnetically closely coupled owing to the presence of element 308-1. Hence, the oscillator 262 signal is coupled to detector 264 and the detector provides a logical 1 or high signal on lead 272. This causes gate 274 to become conductive, so that windings 124-2 and **124-*n* are coupled to oscillator 262. At the same time, the control signal from detector 264 now causes switching network 270 to connect leads 280 to leads 284, thereby coupling windings 125 to individual/master decoder 266. The particular arrangement of active and inactive elements 308 now determines which of secondary windings 125 have the oscillator 262** signal coupled to them.

Individual/master decoder 266 senses the pattern of secondary windings 125 which have the osciallator signal on them, which pattern corresponds to the pattern of active elements 308, and compare this pattern to an internally stored pattern to determine whether the proper individual or master key is present in cylinder 100. If a proper individual key is present, decoder 266 produces a logical 1 level on lead 288 and if a proper master key is present, it produces a logical 1 level on lead 290, both of these leads being connected to the input of an OR gate 292, the output of which is coupled to solenoid 225 through a driver 294. Decoder 266 also receives a signal from optical sensor 208 via lead 263, which permits decoder 266 to be placed in the adaptive mode with respect to the individual key combination by using reset package 500, as already explained. Upon entering this adaptive mode, decoder 266 provides a logical 0 or low level on lead 287 (under normal operation, a logical 1 or high level appears on this lead). Decoder 266 also receives a master reset signal from decoder 268 via lead 267, which signal can be provided to decoder 268 via emergency key assembly 400. The master reset signal places decoder 266 in an adaptive mode with respect to the master key combination so that the door lock security apparatus can be adjusted to recognize the new master key combination.

As explained previously, in the illustrative embodiment pushbutton 204 must be depressed in order to operate thumb turn 22 to extend dead bolt 24. As shown in FIG. 16, pushbutton 204 is a normally open switch which is connected to ground upon depression. This pushbutton is coupled to OR gate 292 and individual/-master decoder 266 via inverter 269 and lead 270. The depression of this pushbutton, causes individual/master decoder 266 to ignore all master keys so that the door lock can be operated only with the proper individual key or an emergency key, thereby providing a room occupant with an additional element of security when he is inside the room. In addition, depressing pushbutton 204 results in the signal on lead 265 going high (this signal is normally low) and this high level is coupled through a driver 266 to enable a power solenoid (not shown). This solenoid is within the room and is connected to provide power to the room air conditioning and heating unit when enabled. Thus, power will be turned on only when the door is locked from within. The effect of depressing pushbutton 204 is negated the first time the proper individual key is inserted into cylinder assembly 100. Hence, when an occupant leaves the room and locks the door, the master key will thereafter be able to operate the door and power is turned off, thereby resulting in energy savings.

From the foregoing description, it will be appreciated that solenoid 225 is activated whenever the output of OR gate 292 goes high (i.e., during the presence of a proper individual/master or emergency key, or upon depression of pushbutton 204), and that solenoid 258 is activated whenever the signal on lead 286 goes high (i.e., only when a proper emergency key is present in cylinder assembly 100).

One-shot 289 serves the purpose of limiting the time in which a correct combination can be detected. The duration of its output pulse is selected to allow a reasonable time for detecting an individual or master key combination. Initially, one-shot 289 is triggered by the positive going transition in the output of detector 264. When the one-shot times out, its low output will be transmitted to detector 264 via lead 293 if the output of OR gate 292 is low (i.e., no correct combination detected). This low level resets detector 264 so that the signal on lead 272 goes low, thereby shutting down or "timing out" the operation of control assembly 200.

Operation can be resumed by removing and reinserting the key 300.

The only electronics shown in FIG. 16 which, as yet, has not been discussed is that relating to the testing of battery 260 and to indicating that the apparatus is set to its reset mode with respect to the individual key combination. A conventional battery tester 295 is coupled to battery 260 and provides to OR gate 297 a digital signal which is high when the battery is operative and low when the battery is inoperative. OR gate 297 also receives the signal from a divide-by-P counter 296 which is connected to divide the frequency of the signal from oscillator 262. The signal from counter 296 is also provided to divide-by-Q counter 283, which serves further to divide the frequency of the signal from counter 296. The signal from counter 283 is coupled to OR gate 285, which also receives a control signal from individual/-master decoder 266 via lead 287. As explained above this control signal is normally high, but goes low when decoder 266 enters the adaptive mode with respect to the individual key combination. In the preferred embodiment, P is selected so that counter 296 provides OR gate 297 with a frequency in the range of 10–16 Hertz and Q is selected to divide down further to a frequency of 1–2 Hertz.

In operation, as long as battery 260 remains effective, battery tester 295 provides a high input to OR gate 297 and as long as decoder 266 is in its normal mode, OR gate 285 receives a high input and both OR gates enable AND gate 276. Thus, when an individual or master key is inserted into cylinder assembly 100 and detector 264 produces a logical 1 output, this logical 1 is transmitted via lead 278 through AND gate 276 and driver 275 to indicator 209, thereby causing the indicator to light. When battery 260 begins to fail, battery tester 295 provides a logical zero level to OR gate 297, so that the output of the OR gate goes high only on the positive portions of the signal from counter 296. Similarly, when decoder 266 enters the adaptive mode with respect to the individual key, combination, the signal on lead 287 goes low, so that the output of OR gate 285 goes high only on the positive portions of the signal from counter 283. Thus, when an individual or master key is present in cylinder assembly 100, AND gate 276 will transmit the signal from detector 264 only on the positive portions of the signal from counter 296 or counter 283, so that indicator 209 flashes at a fast (10–16 Hz) or slow (1–2 Hz), depending on whether failure of battery 260 is impending or whether reset pack 500 is being applied to put the apparatus in its adaptive mode with respect to the individual key combination.

If battery 260 actually fails, it will be necessary to use an emergency key in order to unlock door 8. As already explained, such a key has an internal battery which is connected across battery 260 via leads 142 and 144. As can be seen in FIG. 16, lead 142 has a series diode 261. From the polarity of the diode, it will be appreciated that current will flow in lead 142 only when the voltage of the battery in the emergency key exceeds the voltage of battery 260 (i.e., when battery 260 is failing).

Figure 17:
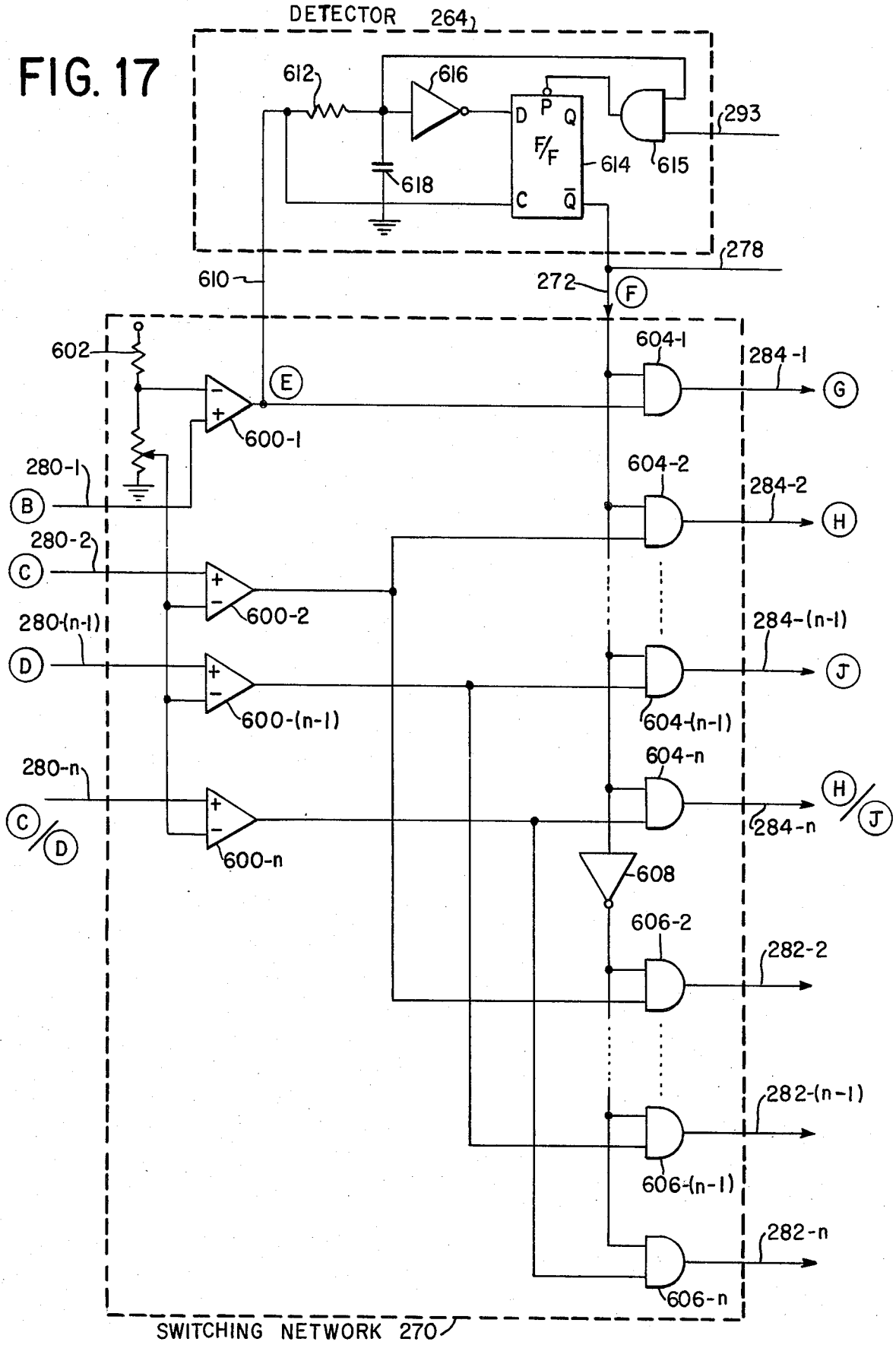
FIG. 17 is a schematic circuit diagram illustrating the details of detector 264 and switching network 270 of FIG. 16.
Figure 18:
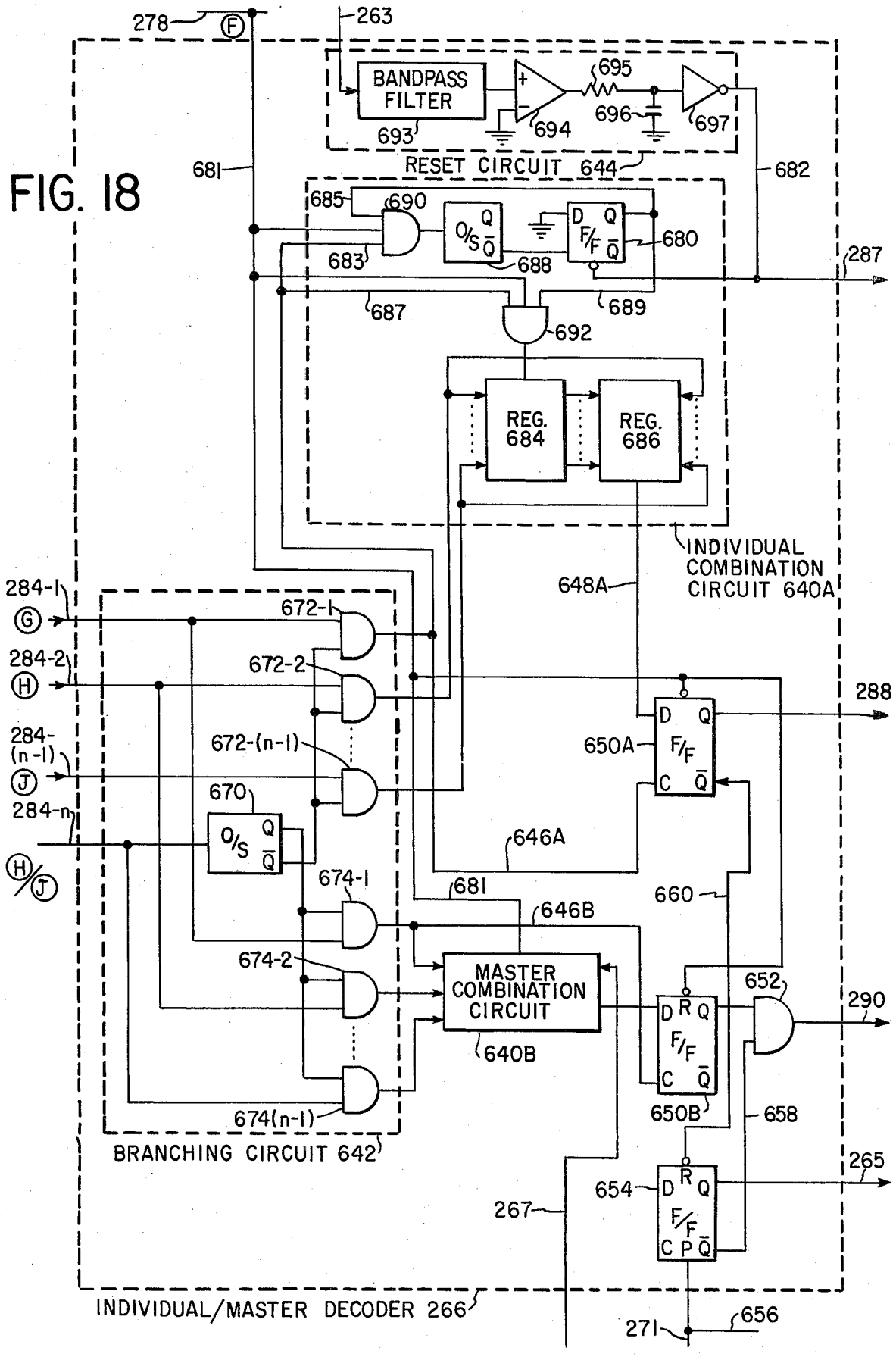
FIG. 18 is a schematic circuit diagram illustrating the details of individual/master decoder 266 of FIG. 16.

The circuit details of detector 264 and switching network 270 are shown in FIG. 17 and the circuit details of individual/master decoder 266 are shown in FIG. 18. In these figures, the components of the corresponding functional blocks are enclosed in a broken line box which is appropriately labeled. The operation of these circuits will be described with the aid of the wave form chart of FIG. 19 in which individual wave forms are represented by capital letters. In FIGS. 17 and 18 these letters are indicated at the positions in the circuit where the corresponding wave form appears and the wave form A is the signal produced by oscillator 262.

Leads 280-1 through **280-*n* are each applied to a respective analog comparator 600-1 through 600-*n*, the other input which is a reference signal produced by a resistor string 602 which is connected across battery 260. It should be noted that comparator 600-1 has a higher reference voltage than the remaining comparators. Hence, if the same sine wave signal were applied to each of leads 280, comparator 600-1 would produce a pulse which begins later and terminates sooner than the pulse produced by each of the other comparators. The output of each of comparators 600 is provided to a corresponding one of AND gates 604 and the outputs of each of comparators 600-2 through 600-*n* are provided to the inputs of AND gates 606-2 through 606-*n*, respectively. A second input to each of AND gates 604 is the control signal from detector 264, and the same signal is applied to each of AND gates 606 through an inverter 608**.

The output signal of comparator 600-1 is coupled to detector 264 via lead 610. Although in FIG. 16 detector 264 is shown connected directly to winding 125-1, coupling the input to detector 264 from comparator 600-1 is convenient here, because it avoids having to use a separate comparator within detector 264. The signal on lead 610 is applied to a resistor 612 and to the clock input of flip-flop 614. The other end of resistor 612 is connected to the preset input of flip-flop 614 through AND gate 615, to the data input of flip-flop 614 through inverter 616 and to a capacitor 618 which is connected to ground. The other input to AND gate 615 is the system "time out" signal on lead 293 and the output of the AND gate serves to preset flip-flop 614 when it goes low. The control signal output from detector 264 is provided at the Q output of flip-flop 614.

Wave form B represents the signal appearing on lead 280-1. When an individual or master key is not present in cylinder assembly 100 (prior to time $t_1$, and subsequent to time $t_2$ in FIG. 19) the signal from oscillator 262 is coupled to lead 280-1 in substantially attenuated form (see wave form B in FIG. 17) and its amplitude does not exceed the reference voltage applied to comparator 600-1. As a result, comparator 600-1 produces a logical 0 or low output (see wave form E) which discharges capacitor 618 and is coupled to the preset input of flip-flop 614, thereby presetting the flip-flop through AND gate 615 and causing the control signal produced by detector 264 (waveform F) to be low. This disables AND gates 604, causing their outputs to stay low, and also decouples windings 124-2 through **124-*n* from oscillator 262, as already explained, so that leads 280-2 through 280-*n* have no signals on them (waveforms C or D). At the same time, AND gates 606 are enabled through inverter 608, so that if an emergency key were present within cylinder 100, signals therefrom could be transmitted through comparator 600-2 through 600-*n* and AND gates 606-2 through 606-*n* without interference from oscillator 262**.

At time $t_1$, an individual or master key is inserted into cylinder assembly 100 (but is again removed at time $t_2$). Inasmuch as keys of this type always have an active element in position 1, close coupling between windings 124-1 and 125-1 is immediately established and the signal on lead 280-1 (wave form B) immediately increases in amplitude so as to exceed the reference voltage of comparator 600-1 over a portion of its positive half cycle. This produces a pulse in wave form E during the interval that wave form B exceeds the reference voltage of comparator 600-1. The sequence of such pulses charges capacitor 618 via lead 610 and resistor 612 and is also utilized to clock flip-flop 614. As long as the voltage across capacitor 618 remains below the threshold level of inverter 616, a logical one input is applied to the D input of flip-flop 614 and the flip-flop continues to produce a logical 0 level on lead 272. Eventually, capacitor 618 is charged to a level above the threshold voltage of inverter 616, so that a logical 0 is applied to the D input of flip-flop 614. The next positive-going transition of a pulse in wave form E will then cause the Q bar output of flip-flop 614 to go high, thereby providing an enable level in the control signal from detector 264 (waveform F). Oscillator 262 is then coupled to windings 124-2 through **124-*n* by virtue of gate 274 being conductive, AND gates 604 are enabled and AND gates 606 are disabled through inverter 608**.

With oscillator 262 now coupled to all of windings 124, signals are induced in all of windings 125. Those windings in a position where the key has an active element have a large amplitude signal induced in them (wave form C) and those windings in a position where the key has an inactive element have a low amplitude signal induced in them (wave form D). By design, the low amplitude signals are substantially below the reference voltage for comparators 600-2 through **600-*n*, whereas the high amplitude signals are substantially above these reference voltages. As a result, those comparators which receive high amplitude signals transmit a pulse through the corresponding one of AND gates 604 during the interval that the signal exceeds the reference voltage of the comparator (wave form H), whereas the comparators receiving low amplitude signals transmit a logical 0 level (wave form J). It should be noted that the pulses in wave form H are substantially wider than the pulses in wave forms for comparator 600-2 through 600-*n* than for comparator 600-1**. This was done in order to permit the transitions of pulses in wave form G to occur during the pulses in wave form H so that wave form G could be used for clocking purposes, as will be explained in more detail below.

In the preferred embodiment, position n in individual and master keys is reserved for indicating the type of key. In an individual key this position will always include an inactive element which will produce wave form J on lead **284-*n* whereas in a master key this position will always include an active element which will produce wave form H on lead 284-*n***.

Referring now to FIG. 18, there are shown the circuit details of individual/master decoder 266. This decoder broadly comprises an individual combination circuit 640A which stores and detects the correct individual combination for the door lock security apparatus; a master combination circuit 640B which stores and recognizes the correct master combination for the door lock security apparatus; a branching circuit 642 which couples the signals on leads 284-1 through 284-($n-1$) to either circuit 640A or 640B, depending upon whether an individual or master key is inserted into cylinder assembly 100; and a reset circuit 644 responsive to optical sensor 208 to reset individual combination circuit 640A to an adaptive mode in which the combination of an individual key inserted in cylinder assembly 100 will be retained as the correct individual key combination.

In operation, the signals on leads 284 are automatically applied to either circuit 640A or 640B and the signal on lead 284-1 (wave form G) is applied to either lead 646A or lead 646B, depending upon whether an individual or master key is present within cylinder assembly 100. Within the combination circuit (either 640A or 640B), the signals on leads 284-2 through 284-($n-1$) are compared to a stored signal representing the corresponding combination of the door lock security apparatus. If these signals coincide with the stored combination, the corresponding combination circuit produces a logical 1 output on its output lead (either lead 648A or lead 648B). This logical 1 signal is connected to the D input of a corresponding flip-flop 650A or 650B and causes that flip-flop to produce a logical 1 at its Q output upon the next occurrence of a positive pulse transition on lead 284-1 (wave form G), which is coupled to the clock input of the flip-flop via either lead 646A or lead 646B. The Q output of flip-flop 650A is produced on lead 288 and its Q output is provided via lead 660 to the reset input of flip-flop 654, and the output of flip-flop 650B is coupled to lead 290 through AND gate 652.

AND gate 652 permits a room occupant to prevent the opening of door 8 with a master key when he locks the door by means of thumb turn 22. As has already been explained, locking the door in this fashion requires that button 204 be depressed. This couples a logical 1 signal to the preset (P) input of flip-flop 654 via leads 271 and 656, thereby producing a logical 1 output on lead 265 (the Q output of flip-flop 654) and a logical 0 output on lead 658 (the Q output of flip-flop 654). The logical 1 output on lead 265 operates a power enable solenoid (not shown) through driver 266, and the logical 0 output on lead 658 disables AND gate 652, so that no logical 1 signal can be produced on lead 290 by master combination circuit 640B to permit the lock to be operated. Upon the next insertion of the correct individual key in cylinder assembly 100, flip-flop 650 is eventually set, as explained above, so that the signal on lead 660 (the Q output of flip-flop 650A) goes low. The low level on lead 660 resets flip-flop 654 and the signal on lead 658 then returns to the logical 1 state, so that the Q output of flip-flop 650B may be transmitted through AND gate 652 to lead 290 in order to operate solenoid 225. At the same time, the signal on lead 265 goes to the logical 0 state, so that the output of driver 266 disables the power enable solenoid. Thus, a room occupant may exclude a master key and will turn on power (e.g. to air conditioner or heater) when operating the lock from inside, but will enable the use of a master key and will turn off power when he leaves the room and locks the door from outside. These are operational features of the present invention which are not available in the original mechanical lock.

Like individual combination circuit 640A, master combination circuit 640B may be set to an adaptive mode in which the combination of the next master key inserted in cylinder assembly 100 will be stored as the correct master combination for the door lock security apparatus. For the master combination circuit, this is achieved by means of a command signal which is coupled from emergency decoder 268 via lead 267.

Branching circuit 642 includes a one shot 670 which is triggered by the signal on lead **284-*n*. The Q output of the one shot enables a plurality of AND gates 672 each of which receives a different one of the signals on correspondingly suffixed leads 284-1 through 284-($n-1$), and the Q output of the one shot enables a plurality of AND gate 674, each of which similarly receives a corresponding one of the signals on correspondingly suffixed leads 284-1 through 284-$(n-1)$. The outputs of AND gates 672 are applied in parallel fashion to individual combination circuit 640A and the outputs of AND gate 674 are applied in parallel fashion to master combination circuit 640B. In addition, the outputs of AND gates 672-1 and 674-1 are applied to leads 646A and 646B**, respectively, and serve as clocking signals for the corresponding combination circuits and the flip-flops associated therewith.

In operation, the signal on lead 284-*n* has the form of waveform J when an individual key is present in cylinder assembly 100 and has the form of waveform H when a master key is present. If the signal has the form of waveform J, one shot 670 is never triggered and its Q output is low while its Q output is high. Hence, the signals from leads 284 are coupled through AND gates 672 to individual combination circuit 640A. On the other hand, when waveform H is on lead 284-*n*, one shot 670 is triggered on the positive going transition of each pulse. Moreover, one shot 670 is designed so that its pulse duration exceeds the time between successive pulses in waveform H, so that a continuous logical 1 level is produced on the Q output of the one shot and a continuous logical 0 level is produced on the Q output of the one shot. This results in the signals on leads 284 being coupled through AND gates 674 to master combination circuit 640B and to waveform G being produced on lead 646B.

Combination circuits 640A and 640B are identical, both as to structure and operation. Hence, only individual combination circuit 640A will be described in detail. Combination circuit 640A broadly comprises a mode flip-flop 680 which is preset by reset circuit 644 via a lead 682 to place the combination circuit in its adaptive mode; a storage register 684 which receives the outputs of AND gates 672-2 through 672-$(n-1)$ and stores the same when circuit 640A is in the adaptive mode; and a multidigit comparator 686 which receives the outputs of AND gates 672-2 through 672-$(n-1)$ and the bits stored in register 684 to produce a signal on lead 648A indicative of bitwise coincidence therebetween.

Flip-flop 680 has its D input coupled to ground and is clocked with the Q output of one shot 688 which is triggered by the output from AND gate 690. AND gate 690 receives the waveform F via leads 278 and 681, the signal from AND gate 672-1 (waveform G) via lead 683, and the Q output of flip-flop 680 via lead 685. Register 684 is clocked with the output of AND gate 692 which receives the output of AND gate 672-1 (waveform G) via lead 687, the waveform F via leads 278 and 681, and the Q output of flip-flop 680 via lead 689.

Under normal operation, the Q output of mode flip-flop 680 is low, so that a new combination cannot be stored on register 684 and circuit 640A merely serves to compare the signals at the outputs of AND gates 672-2 through 672-$(n-1)$ to the combination stored in register 684. Comparator 686 is designed to produce a logical 1 output during any interval in which the output of each of gates 672-2 through 672-$(n-1)$ coincides in state with the corresponding bit stored in register 684. The comparison within comparator 686 is performed continuously, but flip-flop 650A is clocked only on positive going edges of waveform G. Hence, it is only the state of the signals on AND gates 672-2 through 672-$(n-1)$ immediately preceding the occurrence of a pulse in waveform G which is compared to the bits stored in register 684. Consequently, if the pattern of the waveforms H and J at the outputs of AND gates 672 corresponds, respectively, to the pattern of logical 1 and logical 0 bits at the output of register 684, flip-flop 650A will produce a logical 1 output on lead 288, thereby indicating that the correct individual key is being used within cylinder assembly 100 and permitting the lock to be operated.

Individual combination circuit 640A is placed in the adaptive mode when a command signal (a logical 0 level) is received from reset circuit 644 via lead 682. This command signal acts to preset flip-flop 680. If the preset occurs when no individual key is present in cylinder assembly 100, it will have no effect on the remainder of circuit 640A, since waveform F will be low and AND gates 690 and 692 will therefore be disabled. Should an individual key be present or subsequently inserted in cylinder assembly 100, preseting flip-flop 680 will enable AND gate 690 via lead 685 and AND gate 692 via lead 689. As a result, the next positive-going pulse transition occurring at the output of AND gate 672-1 (waveform G) will trigger one shot 688 and will clock register 684.

Figure 19:
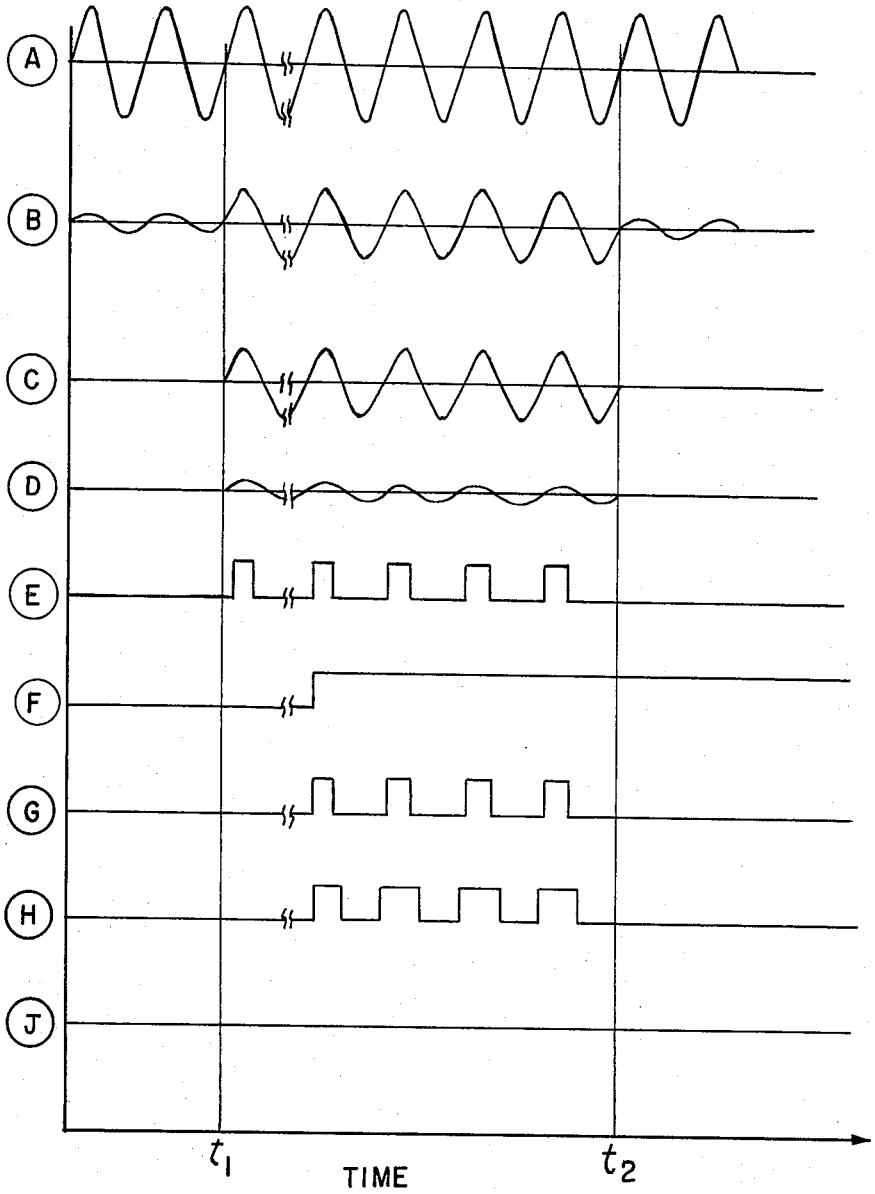
FIG. 19 is a wave form chart useful in explaining the operation of the schematic circuits of FIGS. 17 and 18.

Triggering one shot 688 has no immediate effect on circuit operation; however, clocking register 684 causes storage of the states of the signals at the outputs of AND gates 672-2 through 672-$(n-1)$. Referring to FIG. 19, it will be appreciated that those AND gates which have waveform H applied to them will have a pulse present at the instant of clocking and will therefore cause a logical 1 to be stored in the corresponding position in register 684, whereas those gates receiving waveform J will cause a logical 0 to be stored in the corresponding position in register 684. Inasmuch as comparator 686 continues to function under normal operation, its output signal is clocked into flip-flop 650A. This operation continues as long as the Q output of one shot 688 remains in the logical 0 state. However, as soon as one shot 688 times out, its Q output goes high and the logical 0 at the D input of flip-flop 680 is clocked into the flip-flop, thereby causing the Q output of the flip-flop to go low and disabling AND gates 690 and 692. With the timing out of one shot 688, individual combination circuit 640A returns to its normal mode of operation and remains in this mode until flip-flop 680 is once more preset.

Reset circuit 644 responds to an electrical signal received from optical sensor 208 via lead 263. This electrical signal is generated by optical sensor 208 in response to the operation of reset pack 500, as already explained. In reset circuit 644, the signal received via lead 263 is applied to a bandpass filter 693 and will be transmitted therethrough only if its frequency is in a predefined frequency band. The signal from the bandpass filter is rectified and squared in an analog comparator 694 and the resulting pulses are utilized to charge capacitor 696 through resistor 695. After the voltage on capacitor 696 exceeds the threshold level of inverter 697, a logical 0 level is produced on lead 682, which places individual combination circuit 640A into its adaptive mode, as already explained.

When a master key is utilized in cylinder assembly 100, branching circuit 642 provides the signals on leads 284 to master combination circuit 640B, which is structurally and operationally identical to individual combination circuit 640A. Master combination circuit 640B is placed into its adaptive mode by means of a signal applied from emergency decoder 268 via lead 267.

Figure 20:
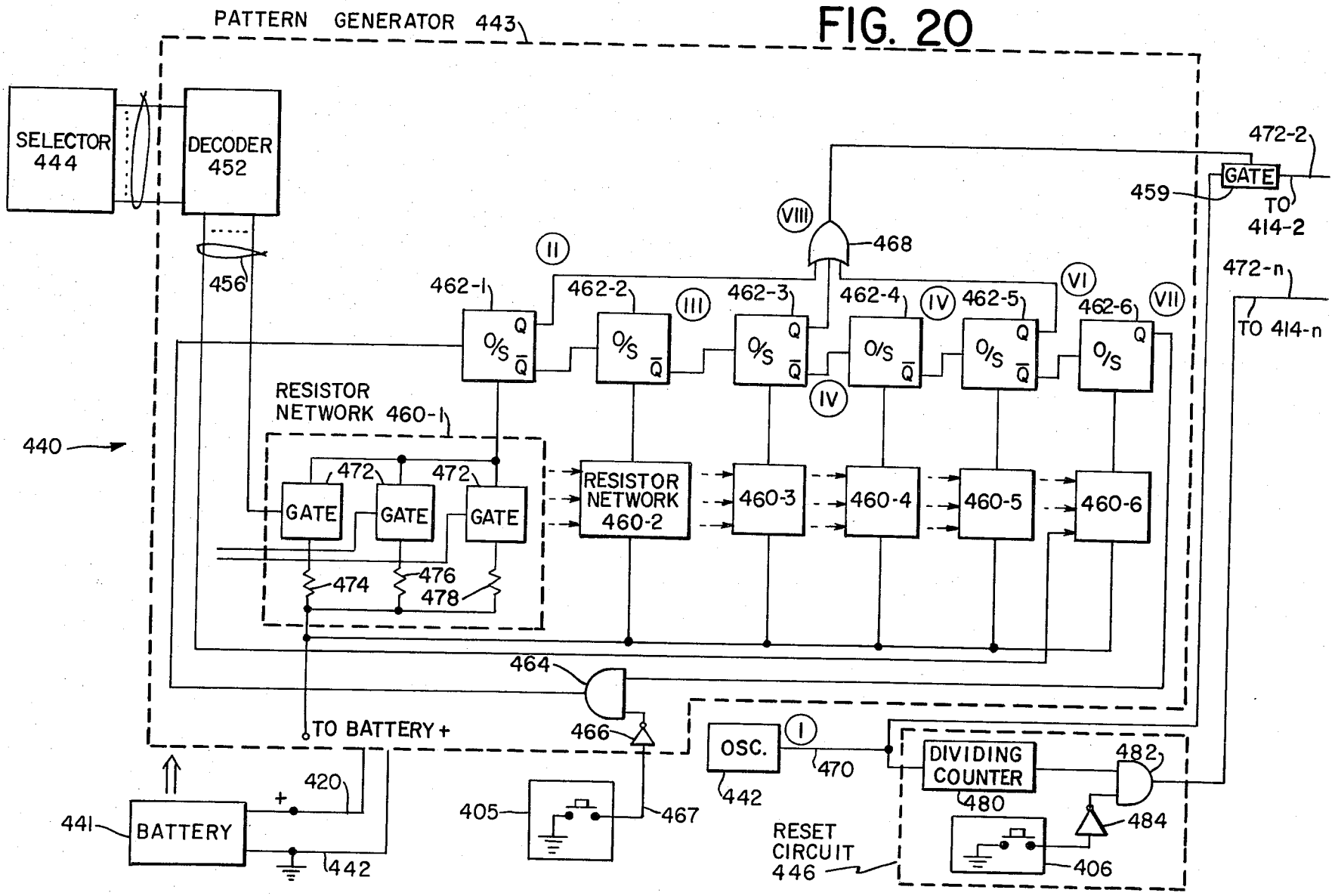
FIG. 20 is a circuit schematic diagram of the electronics associated with the emergency key assembly.
Figure 22:
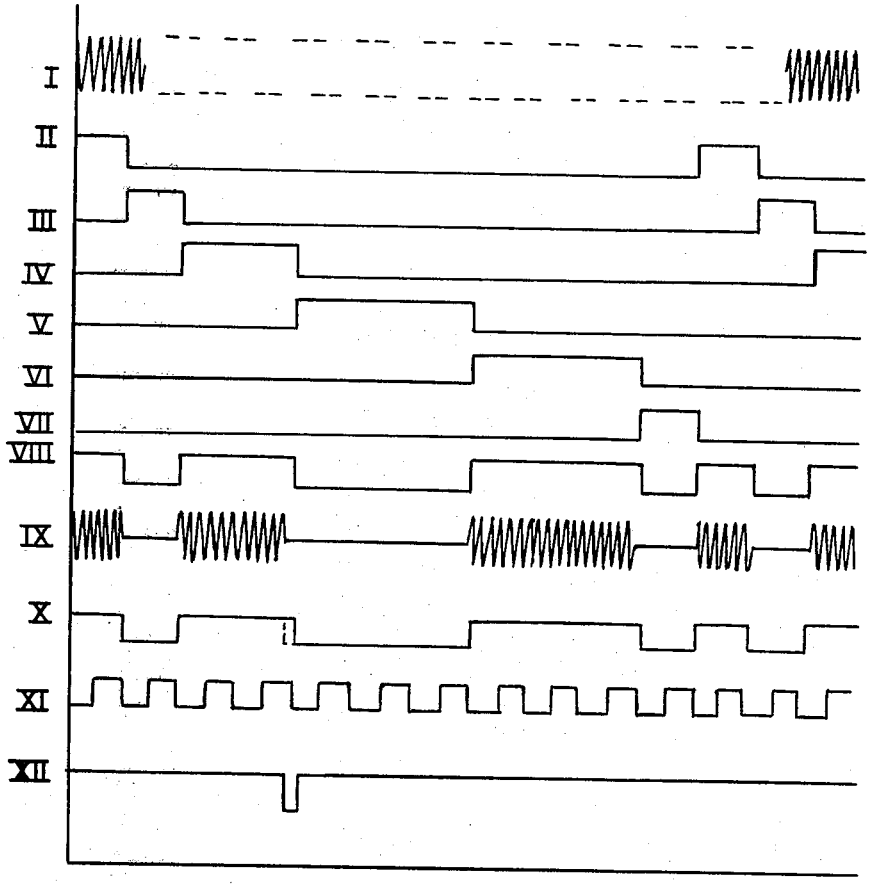
FIG. 22 is a wave form chart useful in explaining the operation of the circuits schematically represented in FIGS. 20 and 21.

For convenience of desciption, emergency key electronics 440 will be described in detail prior to describing emergency decoder 268. A circuit schematic diagram for electronics 440 appears in FIG. 20 and will be described with the aid of the timing chart of FIG. 22.

Emergency key electronics 440 broadly comprises: a battery 441 which provides power for the electronics; an oscillator 442 providing a signal of predetermined frequency, preferably different from the frequency of oscillator 262; a pattern generator 443 which produces a signal for application to of winding 414-2 (in position 2) of master key 402; a selector 444, for example a plurality of thumb wheel switches, for controlling pattern generator 443; and a reset circuit 446 which is operable to provide a signal on winding **414-*n* (in position n) to produce a reset of the master key combination. In operation, the windings 414-2 and 414-*n* in emergency key 402 receive a signal from emergency key electronics 440 comprising a sequence of signal bursts from oscillator 442. Winding 414-*n* is coupled to reset 446 and serves to actuate emergency decoder 268 so as to reset the master key code of individual/master decoder 266**.

The code set into selector 444 is provided to pattern generator 443 via leads 450 which couple the code to decoder 452. Decoder 452 converts the code of selector 444 to a set of signals which are useful in operating pattern generator 443 and which are provided on leads 456. Leads 456 are divided into sub-groups, each including three leads and each of the sub-groups controls one of resistor networks 460.

Each of resistor networks 460 is connected in series between the power side of battery 441 and a control point on the correspondingly suffixed one of one-shots 462 to control the duration of the pulse produced when the corresponding one shot is triggered. One-shots 462 are connected in cascade with the Q output of each stage connected to trigger a succeeding stage. The Q output of one-shot 462-6 is fed back to trigger one-shot 462-1 through AND gate 464, so that when the AND gate is enabled through an inverter 466, the chain of one shots triggers continuously on a repetitive basis. The Q outputs of one shots 462-1, 462-3 and 462-5 are combined in an OR gate 468 to yield a composite waveform (waveform VIII) which is provided as a control input to analog gate 459.

The output signal of oscillator 442 (waveform I) is transmitted through analog gate 459 under control of the signal from OR gate 463. (the composite waveform VIII). Gate 459 transmits only when a logical 1 level is applied from OR gate 463 and, as a result, transmits an on/off keyed version of that signal (waveform IX).

In practice, each of resistor networks 460 includes a plurality, for example, three branches connected in parallel between an external timing resistor terminal of corresponding one shot and the power side of battery 441. Each branch includes an analog gate which is controlled by one of leads 456 and a series resistor. The level of the voltage applied to each gate through the corresponding one of leads 456 determines whether that gate is on or off. This in turn establishes which of the resistors are connected in parallel between the one shot and battery, thereby determining the duration of the pulse produced by the one-shot. If the resistors 474, 476 and 478 in the resistor networks 460 are selected to have resistances in the ratio of 4:2:1, it is possible to control resistor networks 460 so that one-shots 462 can produce pulses of any duration ranging from T to 7T where T is the duration obtained by combining resistors 474, 476 and 478 in parallel.

In operation, the production of frequency bursts on lead 472-2 is initiated by depressing pushbutton 405, thereby enabling AND gate 464 through inverter 466. The production of these frequency bursts continues as long as pushbutton 405 is depressed.

In reset circuit 446, the output of oscillator 442 (waveform I) is divided down by dividing counter 480 to obtain a predetermined reset frequency different from any other frequency utilized in the door lock security apparatus. This reset frequency is applied as an input to AND gate 482. The other input to AND gate 482 is provided from pushbutton 406 through inverted 484. In operation, AND gate 482 is normally disabled and transmission from dividing counter 480 to lead **472-*n* is inhibited. Upon depression of pushbutton 406, AND gate 482 is enabled through inverter 484 and a transmission path is established from dividing counter 480 to lead 472-*n*. Inasmuch as lead 472-*n* is connected to winding 414-i n of emergency key 402, a signal at the frequency of dividing counter 480 is produced in winding 414-*n* and is eventually sensed in winding 125-*n***, as has already been explained.

Figure 21:
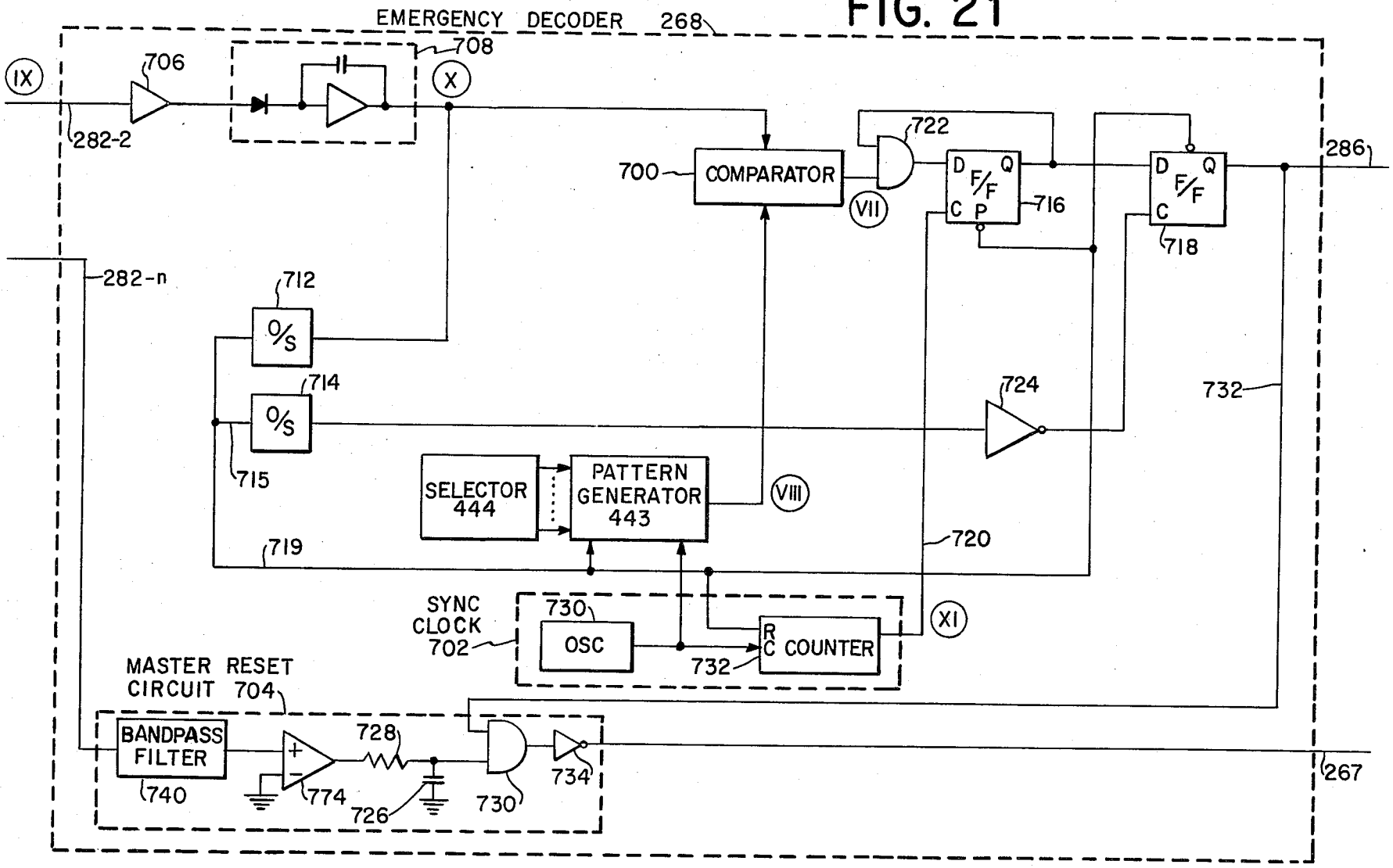
FIG. 21 is a schematic diagram illustrating the circuit details of emergency decoder 268 of FIG. 16.

Returning now to emergency decoder 268, FIG. 21 is a circuit schematic diagram thereof. Emergency decoder 268 broadly comprises a selector 444 and a pattern generator 443 which are identical, respectively, to selector 444 and pattern generator 443 of emergency key electronics 440; a comparator 700 which continuously compares the signal received on leads 282-2 to the signal generated by pattern generator 443; a synchronized clock 702 which is locked in phase to the signals appearing on lead 282-2 and provides timing for emergency decoder 268; and a master reset circuit 704 which responds to the presence on lead **282-*n* of a reset frequency signal for reset circuit 446 by producing a low level on lead 267 which places individual/master decoder 266** in an adaptive mode with respect to the master key combination.

In operation with a proper emergency key, lead 282-2 will have a signal thereon with the waveform IX. Prior to application to comparator 700, this signal is demodulated to produce waveform X at the selected leads. Pattern generator 443, under the control of selector 444, produces the waveform VIII which is compared for correspondence with the demodulated waveform in comparator 700, and a logical 1 output signal is produced on lead 286 only when the demodulated signal matches the signal from the pattern generator 443.

In emergency decoder 268, the signal on lead 282-2 is first amplified in a conventional amplifier 706 and is then passed through a peak detector and demodulator 708, which effects the rectification of the signal and produces a signal which corresponds to the envelope of the modulation of the rectified signal. The demodulated signal has positive-going transitions corresponding to the positive-going transitions in the envelope of the time varying input signal. These positive going transitions serve to trigger a one shot 712 which produces a pulse of long duration compared with the minimum repetition rate of transitions at the output of OR gate 710. As a result, one shot 712 is triggered when an initial transition occurs in the demodulated signal and is thereafter retriggered so that its output continues to stay high as long as an emergency key is present in cylinder assembly 100. The output pulse of this one-shot is applied.

The output pulse of this one-shot is applied to the trigger input of a one shot 714 via lead 715 and, to synchronized clock 702, pattern generator 443, the preset input of a flip-flop 716 and the reset input of a flip-flop 718 via lead 719.

When the output of one shot 712 goes high, the output of synchronized clock 702 (waveform XI on lead 720) experiences a negative-going transition and thereafter produces a square wave signal with frequency 1/T, where T is the minimum duration oscillator burst of an input signal on leads 282. When the output of one shot 712 goes high, this also presets flip-flop 716, thereby enabling AND gate 722. The signal from comparator 700 is then transmitted through AND gate 722 to the D input of flip-flop 716.

Comparator 700 continuously compares the demodulated input signal with the signal from pattern generator 443 and produces a logical one output only when the demodulated signal is identical with the signal from pattern generator 443. In the event that these is some slight timing descrepancy between the demodulated signal and the signal from pattern generator 443 (e.g. a slight timing perturbation is illustrated in waveform X at 780), comparator 700 could indicate a logical zero even though a correct emergency key was being used (e.g. pulse 781 in wave form XII results from perturbation 780 in wave form X). This false indication is avoided by clocking flip-flop 716 with the positive going transitions on lead 720 (waveform IX), which are always remote in time from transitions in the modulated signals and signals from pattern generator 443 (compare waveform XI with waveform VIII and X).

Should the output of comparator 700 (wave from XII) go low immediately prior to clocking flip-flop 716, the Q output of the flip flop goes low and disables AND gate 722, thereby preventing further transmissions from comparator 700 to flip flop 716. The low state of the Q output of flip flop 716 indicates that the emergency key failed to produce the correct emergency key combination.

Flip flop 718 provides the ultimate indication of whether or not a correct emergency key is present in cylinder assembly 100. The flip flop is reset immediately when the output of one shot 712 goes high, thereby applying a logical zero level on lead 286. Flip flop 718 receives the Q output of flip flop 716 as its D input and is clocked through inverter 274 with the output of one shot 714. Owing to the presence of inverter 724, flip flop 718 will be clocked only when one shot 714 times out. By design, the output pulse width of one shot 714 is selected to be long enough to provide a complete comparison between the demodulated, time-varying signals and the signals from pattern generator 443. When one-shot 714 times out and the negative transition is produced, flip-flop 718 is clocked and produces, on lead 286, a signal which corresponds in state to the state of the Q output of flip flop 716. It will be appreciated that the signal on lead 286 assumes a logical one condition only when all the modulated waveforms correspond to their respective reference wave forms from pattern generator 443.

Synchronized clock 702 includes an oscillator 730 which produces an output signal of the same frequency as oscillator 442 of emergency key electronics 440. This signal is applied to the clock input of a counter 732, which counter is reset by the output signal of one shot 712. The maximum count of counter 732 is selected so that counter will recirculate with a rate of 1/T. The most significant output bit of counter 732 is provided on lead 720 (waveform XI) as the output of synchronized clock 702. This most significant bit output goes low when the counter resets and goes high again midway between negative going transitions.

Master reset circuit 704 includes a bandpass filter 740 which is tuned to the reset frequency produced by reset circuit 446 of emergency key electronics 440. This reset frequency is produced on winding **414-*n* of emergency key 402 when the key is inserted into cylinder assembly 100 and pushbutton 406 is depressed. The signal on winding 414-*n* is coupled to lead 125-*n* of sensor 106-*n* and is provided to lead 282-*n* via lead 280-*n* and switching network 270. In master reset circuit 704, only a signal of predetermined frequency will pass through band filter 740. This signal is rectified and squared up by comparator 724, and the resulting pulses are used to charge capacitor 726 through resistor 728. When the voltage on capacitor 726 reaches the threshold level of AND gate 730, the AND is enabled. The other input to AND gate 30 is provided from lead 286 via lead 732. Thus, the output of AND gate 730 goes high only if the output of flip flop 718 is also high (i.e. only when the correct emergency key is present). The ouitput of AND gate 730 is coupled to lead 267 through inverter 734, so that when the output of AND gate 730 goes high, the level on lead 267 goes low and master combination circuit 640B of individual/master decoder 266** is placed in its adaptive mode, as already explained.

From the foregoing, it will be appreciated that when the correct emergency key is inserted into cylinder assembly 100 and pushbutton 406 is depressed, individual/master decoder 266 is placed in the adaptive mode with respect to the master key code. Consequently, the next master key which is inserted into cylinder combination.

Although preferred embodiments of the invention have been disclosed for illustrative purposes, it will be appreciated by those skilled in the art that many additions, modifications, and substitutions are possible without departing from the scope and spirit of the invention as defined in the accompanying claims.

What is claimed is:

1. In a security apparatus for a mechanical door lock of the type including a key-receiving cylinder rotatably mounted in said lock and coupled by means of a mechanical linkage to lock and unlock said lock upon being rotated, a cylinder assembly comprising:

a main body adapted to be mounted in said lock in place of said key-receiving cylinder;

means on said main body adapted to receive and engage a combination encoding key for mechanically coupling the rotation of said key to said mechanical linkage; and a plurality of sensor elements mounted on said body, each sensor element including a primary and secondary winding and a core component made of low reluctance material, on which said windings are wound, each core component having a gap therein which causes said core component to have a high reluctance, whereby the electromagnetic coupling between the primary and secondary winding on each core component is loose.

2. In a security apparatus for a door lock, a cylinder assembly comprising:

a main body;

a plurality of sensor elements mounted on said body, each sensor element including a primary and secondary winding and a core component made of low reluctance material, on which said windings are wound, each core component having a gap therein which causes said core component to have a high reluctance, whereby the electromagnetic coupling between the primary and secondary winding on each core component is loose;

a housing portion of said body with an internal bore whereon said sensor elements are mounted, said housing portion having a plurality of opposed pairs of channels formed therein so that said pairs are spaced along said housing in the axial dimension of said bore, at least a portion of each channel extending from the exterior of said housing portion into said bore, each of said core components being generally U-shaped and having opposed legs which are closer together than the diameter of said bore, each leg having a cut-out facing the other leg, which cut-out conforms generally to the contour of said bore, said cylinder assembly further comprising a tubular insert dimensioned to be received coaxially within said bore, each core component being mounted on said cylinder assembly by inserting each of the opposed legs into a channel of a respective channel pair so that said cut-outs are generally aligned with the surface of said bore, said insert being mounted into said bore with opposed legs straddling said insert to prevent withdrawal of said cores from the respective channel pair.

3. In combination with the cylinder assembly of claim 2, at least one key adapted to be oriented in a predefined arrangement with respect to said cylinder assembly, each key including a plurality of coding elements each preselectable to have a high or low reluctance, thereby defining the combination of said key, each of said coding elements being positioned on said key to bridge the gap of a respective core component when said key is oriented in said predefined arrangement, so that the low reluctance coding elements bridge the gap in their respective cores, thereby completing a low reluctance path including said core component and providing a close electromagnetic coupling between the primary and secondary windings on said said core component.

4. The combination of claim 3 wherein the gap in each of said core components is between the cut-outs in the legs thereof said key including a shank along which said coding elements are spaced, said shank extending coaxially within said tubular insert with a corresponding coding element between the legs of each core component, when said key is oriented in said predefined arrangement.

5. In combination with the cylinder assembly of claim 1 at least one key adapted to be oriented in a predefined arrangement with respect to said cylinder assembly, each key including means for receipt and engagement by said means for mechanically coupling and a plurality of coding elements each preselectable to have a high or low reluctance, thereby defining the combination of said key, each of said coding elements being positioned on said key to bridge the gap of a respective core component when said key is oriented in said predefined arrangment, so that the low reluctance coding elements bridge the gap in their respective cores, thereby completing a low reluctance path including said core component and providing close electromagnetic coupling between the primary and secondary winding on said core component.

6. The combination of claim 3 wherein each of said core components is generally U-shaped with the open portion of the U defining said gap and said core components are mounted in spaced alignment so that the open portions of all components aligned, said key including a shank along which said coding elements are spaced, said shank extending in alignment with the open portion of each U-shaped element so that a respective coding element bridges each core when said key is oriented in said predefined arrangement.

7. In a door lock security apparatus incorporating the combination of claim 3 or claim 5, the door lock being adapted to be locked and unlocked with at least one of said keys when it is oriented in said predefined arrangement:

disabling means coupled to said lock for normally preventing the locking and unlocking thereof, and actuable to enable locking and unlocking; and means for actuating said disabling means when a key having a preselected combination is oriented in said predefined arrangement.

8. Apparatus according to claim 7 wherein the lock is locked and unlocked by opposite rotations of an internal shaft, said disabling means comprising:

a locking disc coaxially secured to said shaft for rotation therewith;

first engaging means on said disc;

second engaging means normally positioned in the path traversed by said first engaging means when said shaft rotates, so that said first and second engaging means interengage at a point along said path to prevent further rotation of said shaft, said second engaging means being mounted for movement between its normal position and an inactive position not in said path; and moving means coupled to said second engaging means and controlled by said actuating means for moving said second engaging means to its inactive positon when a key having a preselected combination is oriented in said predefined arrangement, said second engaging means being restored to its normal position otherwise.

9. Apparatus according to claim 7 wherein said actuating means comprises:

means for storing said preselected combination in the form of an electrical reference combination signal;

a source of an energizing signal coupled to the primary winding of each core component;

sensing means coupled to the secondary winding of each core component for sening the amplitude of the signal on each winding, the secondary windings disposed on core components in which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings; and means for comparing said reference combination signal and said key combination signal, said comparing means producing an actuating signal for actuating said disabling means when said key and reference combination signals agree.

10. Apparatus according to claim 8 wherein said actuating means comprises:

means for storing said preselected combination in the form of an electrical reference combination signal;

a source of an energizing signal coupled to the primary winding of each core component;

sensing means coupled to the secondary winding of each core component for sensing the amplitude of the signal on each winding, the secondary windings disposed on core components in which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings; and means for comparing said reference combination signal and said key combination signal, said comparing means producing an actuating signal when said key and reference combinations agree, said actuating signal being applied to said moving means and operative to cause the same to move said second engaging means to its inactive position.

11. Apparatus according to claim 9 further comprising:

reset means;

means controlled by said reset means storing said storing means to store a new reference combination signal thereby placing said apparatus in an adaptive mode of operation; and means controlled by said reset means for providing said key combination signal to said conditioning means as the new reference combination signal.

12. Apparatus according to claim 11 wherein said reset means comprises:

light responsive means for producing an electrical signal; and means for detecting when said electrical signal has a frequency in a predefined range, and producing a control signal for said conditioning means and said providing means;

said apparatus being placed in its adaptive mode by illuminating said light responsive means with a sequence of light flashes having a repetition rate in said predefined frequency range.

13. In a door lock security apparatus incorporating the combination of claim 3 or claim 5, the door lock being adapted to be locked and unlocked by any one of a group of said keys having preselected different combinations when said one key is oriented in said predefined arrangement:

disabling means coupled to said lock for normally preventing the locking and unlocking thereof, and actuable to enable locking and unlocking; and means for actuating said disabling means when a key having a preselected combination in said group is oriented in said predefined arrangement.

14. Apparatus according to claim 13 wherein the lock is locked and unlocked by opposite rotations of an internal shaft, said disabling means comprising:

a locking disc coaxially secured to said shaft for rotation therewith;

first engaging means on said disc;

second engaging means normally positioned in the path traversed by said first engaging means when said shaft rotates, so that said first and second engaging means interengage at a point along said path to prevent further rotation of said shaft, said second engaging means being mounted for movement between its normal position and an inactive position not in said path; and moving means coupled to said second engaging means and controlled by said actuating means for moving said second engaging means to its inactive positon when a key having a preselected combination is oriented in said predefined arrangement, said second engaging means being restored to its normal position otherwise.

15. Apparatus according to claim 13 wherein said actuating means comprises:

means for storing said preselected combinations in the form of different electrical reference combination signals;

a source of an energizing signal coupled to the primary winding of each core component;

sensing means coupled to the secondary winding of each core component for sensing the amplitude of the signal on each winding, the secondary windings disposed on core components in which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings;

means for selecting one of said reference combination signals; and means for comparing the selected reference combination signal and said key combination signal, said comparing means producing an actuating signal for actuating said disabling means when said key and reference combination signals agree.

16. Apparatus according to claim 14 wherein said actuating means comprises:

means for storing said preselected combinations in the form of different electrical reference combination signals;

a source of an energizing signal coupled to the primary winding of each core component;

sensing means coupled to the secondary winding of each core component for sensing the amplitude of the signal on each winding, the secondary windings disposed on core components in which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings;

means for selecting one of said reference combination signals; and means for comparing the selected reference combination signal and said key combination signal, said comparing means producing an actuating signal when said key and reference combinations agree, said actuating signal being applied to said moving means and operative to cause the same to move said second engaging means to its inactive position.

17. Apparatus according to claim 15 wherein said selecting means is responsive to said key combination signal and selects predetermined ones of said reference combination signals in the presence of predetermined sets of key combination signals.

18. Apparatus according to claim 15 further comprising:

reset means for a selected reference combination signal;

means controlled by said reset means for conditioning said storing means to store a new reference combination signal in place of the selected one thereby placing said apparatus in an adaptive mode of operation with respect to the selected reference combination signal; and means controlled by said reset means for providing said key combination signal to said storing means as the new selected reference combination signal.

19. Apparatus according to claim 18 wherein said reset means comprises:

light responsive means for producing an electrical signal; and means for detecting when said electrical signal has a frequency in a predefined range, and producing a control signal for said conditioning means and said providing means;

said apparatus being placed in its adaptive mode with respect to the selected reference combination signal by illuminating said light responsive means with a sequence of light flashes having a repetition rate in said predefined frequency range.

20. Apparatus according to claim 17 further comprising:

reset means for a selected reference combination signal;

means controlled by said reset means for conditioning said storing means to store a new reference combination signal in place of the selected one thereby placing said apparatus in an adaptive mode of operation with respect to the selected reference combination signal; and means controlled by said reset means for providing said key combination signal to said storing means as the new selected reference combination signal.

21. Apparatus according to claim 20 wherein at least the selected reset means comprises:

light responsive means for producing an electrical signal; and means for detecting when said electrical signal has a frequency in a predefined range, and producing a control signal for said conditioning means and said providing means;

said apparatus being placed in its adaptive mode with respect to the selected reference combination signal by illuminating said light responsive means with a sequence of light flashes having a repetition rate in said predefined frequency range.

22. In a door lock security system incorporating a plurality of apparatus according to claim 17, at least one master key, each one having a unique combination and being capable of operating a unique subcombination of said apparatus, the apparatus in said subcombination having the master key combination stored in their storing means as one of said reference combination signals, the selecting means including means responding to the presence of a master key combination signal as said key combination signal to select said master key combination of the respective apparatus as the reference combination signal.

23. Apparatus according to claim 7 wherein said actuating means further comprises:

an emergency key assembly including an emergency key having a shank and at least one active element positioned along said shank to align with the gap in one of said core components when the emergency key is in said predefined arrangement, each active element including a core element and an active winding wound thereon, and a sourced of a time-varying emergency signal coupled to at least one of said active windings;

emergency sensing means coupled to the same winding of at least the core components having active elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

24. Apparatus according to claim 23 wherein said emergency key assembly includes a power source and said emergency key includes a pair of terminals coupled to said power source, said apparatus including terminals positioned to contact said emergency key terminals when said emergency key is in said pre defined arrangement, so that said emergency key assembly provides power for said apparatus.

25. A system according to claim 22 wherein the actuating means in each apparatus further comprises:

an emergency key assembly including an emergency key having a shank and at least one active element positioned along said shank to align with the gap at least in one of said core components when the emergency key is in said predefined arrangement, each active element including a core element and an active winding wound thereon, and a source of a time-varying emergency signal coupled to at least one of said active windings;

emergency sensing means coupled to the same winding of at least the core components having aactive elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

26. A system according to claim 25 wherein said emergency key assembly includes a power source and said emergency key includes a pair of terminals coupled to said power source, said apparatus including terminals positioned to contact said emergency key terminals when said emergency key is in said predefined arrangement, so that said emergency key assembly provides power for said apparatus.

27. Apparatus according to any of claim 23 enclosed in a housing mounted on a door next to said lock, the housing including a window permitting access to the interior thereof, said housing having a cover closing said window and locking means locking said cover, said locking means releasing said cover when a proper emergency key is in said predefined arrangement.

28. A system according to claim 25 each of said apparatus is enclosed in a housing mounted on a door next to the respective lock, the housing including a window permitting access to the interior thereof, said housing having a cover closing said window and locking means locking said cover, said locking means releasing said cover when a proper emergency key is in said predefined arrangement.

29. Apparatus used with a lock on a door for a predefined area, which lock may be locked and unlocked from within said area by means of an operating mechanism, said apparatus being operative to control a switching device coupled to a source of electric power, comprising:

preventing means coupled to said lock for normally preventing the locking thereof from within said area and actuable to permit locking thereof from within said area; and enabling means jointly coupled to said preventing means and said switching device and operable to actuate said preventing means while enabling said switching device to provide electric power from said source.

30. Apparatus in accordance with claim 29 wherein said lock includes a bolt mechanism movable to achieve locking and unlocking by means of the rotation of a shaft coupled thereto, said preventing means including means movable between a normal position and an actuated position, said movable means in its normal position engaging said shaft to prevent rotation thereof so that locking is achieved, said movable means in its actuated position being disengaged from said shaft, said enabling means being operable to move said movable means from its normal to its actuated position.

31. In a door lock security apparatus according to claim 1 used with a door lock adapted to be locked and unlocked with at least one of a plurality of keys when the key is oriented in a predefined arrangement with respect to the lock:

disabling means coupled to said lock for normally preventing the locking and unlocking thereof, and actuable to enable locking and unlocking; and means for actuating said disabling means when a key having a preselected combination is oriented in said predefined arrangement.

32. Apparatus according to claim 31 wherein the lock is locked and unlocked by opposite rotations of an internal shaft, said disabling means comprising:

a locking disc coaxially secured to said shaft for rotation therewith;

first engaging means on said disc;

second engaging means normally positioned in the path traversed by said first engaging means when said shaft rotates, so that said first and second engaging means interengage at a point along said path to prevent further rotation of said shaft, said second engaging means being mounted for movement between its normal position and an inactive position not in said path; and moving means coupled to said second engaging means and controlled by said actuating means for moving said second engaging means to its inactive positon when a key having a preselected combination is oriented in said predefined arrangement, said second said second engaging means being restored to its normal position otherwise.

33. Apparatus according to claim 31 wherein said actuating means comprises:

means for storing said preselected combination in the form of an electrical reference combination signal;

a source of an energizing signal coupled to the primary winding of each core component;

sensing means coupled to the secondary winding of each core component for sensing the amplitude of the signal on each winding, the secondary windings disposed on core components in which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings; and means for comparing said reference combination signal and said key combination signal, said comparing means producing an actuating signal for actuating said disabling means when said key and reference combination signals agree.

34. Apparatus according to claim 33 further comprising:

reset means;

means controlled by said reset means for conditioning said storing means to store a new reference combination signal thereby placing said apparatus in an adaptive mode of operation; and means controlled by said reset means for providing said key combination signal to said storing means as the new reference combination signal.

35. Apparatus according to claim 34 wherein said reset means comprises:

light responsive means for producing an electrical signal; and means for detecting when said electrical signal has a frequency in a predefined range, and producing a control signal for said conditioning means and said providing means;

said apparatus being placed in its adaptive mode by illuminating said light responsive means with a sequence of light flashes having a repetition rate in said predefined frequency range.

36. Apparatus according to any of claims 31–35 wherein said actuating means further comprises:

an emergency key assembly including an emergency key having a shank and at least one active element positioned along said shank to align with the gap in one of said core components when the emergency key is in said predefined arrangement, each active element including a core element and an active winding wound thereon, and a source of a time-varying emergency signal coupled to at least one of said active windings;

emergency sensing means coupled to the same winding of at least the core components having active elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

37. Apparatus according to claim 36 wherein said emergency key assembly includes a power source and said emergency key includes a pair of terminals coupled to said power source, said apparatus including terminals positioned to contact said emergency key terminals when said emergency key is in said predefined arrangement, so that said emergency key assembly provides power for said apparatus.

38. In a door lock security apparatus according to claim 1 for use with a door lock adapted to be locked and unlocked by any one of a group of keys having preselected different combinations when said one key is oriented in a predefined arrangement with respect to said apparatus:

disabling means coupled to said lock for normally preventing the locking and unlocking thereof, and actuable to enable locking and unlocking; and means for actuating said disabling means when a key having a preselected combination in said group is oriented in said predefined arrangement.

39. Apparatus according to claim 38 wherein the lock is locked and unlocked by opposite rotations of an internal shaft, said disabling means comprising:

a locking disc coaxially secured to said shaft for rotation therewith;

first engaging means on said disc;

second engaging means normally positioned in the path traversed by said first engaging means when said shaft rotates, so that said first and second engaging means interengage at a point along said path to prevent further rotation of said shaft, said second engaging means being mounted for movement between its normal position and an inactive position not in said path; and moving means coupled to said second engaging means and controlled by said actuating means for moving said second engaging means to its inactive position when a key having a preselected combination is oriented in said predefined arrangement, said second engaging means being restored to its normal position otherwise.

40. Apparatus according to claim 38 wherein said actuating means comprises:

means for storing said preselected combinations in the form of different electrical reference combination signals;

a source of an energizing signal coupled to the primary winding of each core component;

sensing means coupled to the secondary winding of each core component for sensing the amplitude of the signal on each winding, the secondary windings disposed on core components jn which said gap is bridged by a low reluctance coding element having a high signal amplitude above a predefined reference level and the secondary windings disposed on core components in which said gap is not so bridged having a low signal amplitude below said reference level, said sensing means producing a key combination signal representing the arrangement of high and low signal amplitudes on said secondary windings;

means for selecting one of said reference combination signals; and means for comparing the selected reference combination signal and said key combination signal, said comparing means producing an actuating signal for actuating said disabling means when said key and reference combination signals agree.

41. Apparatus according to claim 40 wherein said selecting means is responsive to said key combination signal and selects predetermined ones of said reference combination signals in the presence of predetermined sets of key combination signals.

42. Apparatus according to claim 40 further comprising:

reset means corresponding to each reference combination signal;

means controlled by the reset means of a selected reference combination signal for conditioning said storing means to store a new reference combination signal in place of the selected one, thereby placing said apparatus in an adaptive mode of operation with respect to the selected reference combination signal; and means controlled by said reset means for providing said key combination signal to said conditioning means as the new selected reference combination signal.

43. Apparatus according to claim 42 wherein at least the selected reset means comprises:

light responsive means for producing an electrical signal; and means for detecting when said electrical signal has a frequency in a predefined range, and producing a control signal for said conditioning means and said providing means;

said apparatus being placed in its adaptive mode with respect to the selected reference combination signal by illuminating said light responsive means with a sequence of light flashes having a repetition rate in said predefined frequency range.

44. In a door lock security system incorporating a plurality of apparatus according to claim 41, at least one master key, each one having a unique combination and being capable of operating a unique subcombination of said apparatus, the apparatus in said subcombination having the master key combination stored in their storing means as one of said reference combination signals, the selecting means including means responding to the presence of a master key combination signal as said key combination signal to select said master key combination of the respective apparatus as the reference combination signal.

45. Apparatus according to any of claims 39–44 wherein said actuating means further comprises:

an emergency key assembly including an emergency key having a shank and at least one active element positioned along said shank to align with the gap in one of said core components when the emergency key is in said predefined arrangement, said active element including a core element and an active winding wound thereon, and a source of a time-varying emergency signal coupled to at least one of said active windings;

emergency sensing means coupled to the same winding of at least the core components having active elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

46. In equipment or a system according to any of claims 1–6=32–35 or 38–44 used with a lock on a door for a predefined area, which lock may be locked and unlocked from within said area by means of an operating mechanism, said equipment being operative to control a switching device coupled to a source of electric power, comprising:

preventing means coupled to said lock for normally preventing the locking thereof from within said area and actuable to permit locking thereof from within said area; and enabling means jointly coupled to said preventing means and said switching device and operable to actuate said preventing means while enabling said switching device to provide electric power from said source.

47. Apparatus according to claim 13 wherein said actuating means further comprises:

an emergency key assembly including an emergency key having a shank and at least one active element positioned along said shank to align with the gap in one of said core components when the emergency key is in said predefined arrangement, each active element including a core element and an active winding wound thereon, and a sourced of a time-varying emergency signal coupled to at least one of said active windings;

emergency sensing means coupled to the same winding of at least the core components having active elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

48. Apparatus according to claim 47 enclosed in a housing mounted on a door next to said lock, the housing including a window permitting access to the interior thereof, said housing having a cover closing said window and locking means locking said cover, said locking means releasing said cover when a proper emergency key is in said predefined arrangement.

49. In a door lock security apparatus used with a door lock adapted to be locked and unlocked with at least one of a plurality of keys where the key is oriented in a predefined arrangement with respect to the lock:

a main body;

a plurality of sensor elements mounted on said body, each sensor element including a primary and secondary winding and a core component made of low reluctance material, on which said windings are wound, each core component having a gap therein which causes said core component to have a high reluctance, whereby the electromagnetic coupling between the primary and secondary winding on each core component is loose;

disabling means coupled to said lock for normally preventing the locking and unlocking thereof, and actuable to enable locking and unlocking; and an emergency key assembly including an emergency key having a shank and at least one active element positioned along said shank to align with the gap in one of said core components when the emergency key is in said predefined arrangement, each active element including a core element and an active winding wound thereon, and a source of a time-varying emergency signal coupled to at least one of said active windings;

emergency sensing means coupled to the same winding of at least the core components having active elements aligned therewith for sensing the signal on each winding, only the windings disposed on core components aligned with an active element having a replica of the emergency signal;

means for generating a master reference signal substantially identical to said emergency signal; and means for comparing said emergency reference signal and said replica signal, said comparing means producing an actuating signal for actuating said disabling means when said replica and emergency reference signals are substantially identical.

* * * * *